US012221757B2

(12) United States Patent
Onodera et al.

(10) Patent No.: US 12,221,757 B2
(45) Date of Patent: Feb. 11, 2025

(54) WATERTIGHT STRUCTURE FOR FLAP GATE AND FLAP GATE COMPRISING SAME

(71) Applicant: ASAHI INOVEX Corp., Sapporo (JP)

(72) Inventors: Tetsuo Onodera, Sapporo (JP); Koji Sasayama, Sapporo (JP); Toshio Tsuchiya, Sapporo (JP)

(73) Assignee: ASAHI INOVEX Corp., Sapporo (JP)

( * ) Notice: Subject to any disclaimer, the term of this patent is extended or adjusted under 35 U.S.C. 154(b) by 321 days.

(21) Appl. No.: 17/441,286

(22) PCT Filed: Mar. 19, 2020

(86) PCT No.: PCT/JP2020/012367
§ 371 (c)(1),
(2) Date: Sep. 21, 2021

(87) PCT Pub. No.: WO2020/196290
PCT Pub. Date: Oct. 1, 2020

(65) Prior Publication Data

US 2022/0145562 A1 May 12, 2022

(30) Foreign Application Priority Data

Mar. 22, 2019 (JP) ..... 2019-055243

(51) Int. Cl.
*E02B 7/44* (2006.01)
*E02B 7/40* (2006.01)

(52) U.S. Cl.
CPC ..... *E02B 7/44* (2013.01)

(58) Field of Classification Search
CPC ..... E02B 7/44; E02B 7/205; E02B 8/04
See application file for complete search history.

(56) References Cited

FOREIGN PATENT DOCUMENTS

| | | | | | |
|---|---|---|---|---|---|
| JP | 3500388 | B2 | | 2/2004 | |
| JP | 2015113679 | A | * | 6/2015 | |
| JP | 5905152 | B1 | | 4/2016 | |
| KR | 200361667 | Y1 | * | 3/2005 | |
| KR | 200380458 | Y1 | * | 3/2005 | |
| KR | 1370040 | B1 | * | 3/2014 | |
| KR | 1582592 | B1 | * | 1/2016 | ..... E02B 7/20 |
| KR | 2016001848 | U | * | 5/2016 | |

* cited by examiner

*Primary Examiner* — Frederick L Lagman
*Assistant Examiner* — Stacy N Lawson
(74) *Attorney, Agent, or Firm* — Muncy, Geissler, Olds & Lowe, P.C.

(57) ABSTRACT

A watertight structure in a flap gate 1 provided with a weight-balance supported door 2 to open an opening 200 of a floodgate 100 in a state in which no external force other than gravity is applied, wherein the structure has: a gap opening-closing member 72 that oscillates in the water flow direction and opens and closes a gap C, wherein the gap C is provided between the lower edge 23 of the door 2 and the bottom face 300 of the floodgate 100 in a state in which the door 2 is blocking the floodgate 100; and an opening operation assist means 73 for operating the gap opening-closing member 72 so as to be in an open state by lifting same toward the outer water side.

8 Claims, 23 Drawing Sheets

WATERTIGHT STRUCTURE FOR FLAP GATE AND FLAP GATE COMPRISING SAME

TECHNICAL FIELD

The present invention relates to a watertight structure for a flap gate, the watertight structure being capable of opening and closing a gap between a lower edge of a door that opens and closes an opening portion of a floodgate and a bottom face of the floodgate, and a flap gate including the watertight structure.

BACKGROUND ART

Conventionally, gates for preventing backflow caused by a flood, a storm surge or the like are provided in sluice gates and floodgates installed in rivers, lakes, seacoasts or the like. As an example of the gates that open and close an opening portion of a floodgate, there is a pull-up gate that opens the floodgate opening portion by pulling a door upward. In general, a rack lift is used for lifting the door up and down. In normal times, the floodgate opening portion is kept open to allow water flowing from the inner water side to be drained to the outer water side. If a backflow to the inner water side occurs due to a rise in water level on the outer water side, an operator goes visit the floodgate and performs an operation of closing the floodgate. On the other hand, if the water level on the outer water side is lowered, an operator performs an operation of opening the floodgate again. In this way, the pull-up gate needs to be operated according to the water level, causing the problem of, e.g., securing personnel necessary for the operation.

On the other hand, the present applicant has developed a flap gate capable of automatically opening and closing a floodgate opening portion according to water levels on the inner water side and the outer water side and obtained a patent right for the flap gate before (Patent Literature 1). In the floodgate opening portion on which the flap gate is installed, a rectangular doorstop to be brought into close contact with watertight rubber disposed on an inner water-side surface of the door for ensuring watertightness is disposed. In this case, in order to dispose the doorstop, a step that makes the outer water side one step lower (also referred to as "threshold step") is provided at a bottom face of the floodgate opening portion. Then, in the flap gate, a gap is formed between a doorstop surface of the threshold step and the door by tilting the door by around a few degrees or dozen degrees, allowing smooth drainage of water from the inner water side.

Because of such advantage of the flap gate drawing attention, in recent years, there has been an increasing need for refurbishment to provide the flap gate in order to solve the problem in pull-up gates.

However, the bottom face of the floodgate opening portion on which a pull-up gate is installed is flat and no threshold step is provided at the bottom face. Therefore, if a flap gate is installed on a floodgate with no threshold step and a door is tilted by a few degrees or dozen degrees like in the case where a threshold step is provided, only a small gap is formed between a lower end of the door and a bottom face of a floodgate opening portion. Therefore, water drainage may be hindered even in a state in which the water level on the inner water side is low. On the other hand, a method in which the gap between the door and the bottom face is expanded by increasing the tilting angle of the door is conceivable; however, in a situation in which a backflow occurs due to a rise in water level on the outer water side, a water level necessary for the door to be automatically closed by water pressure also rises. In other words, a response for the door to be automatically closed by water pressure on the outer water side is slow. Therefore, conventionally, refurbishment work for change from a pull-up gate to a flap gate needs the work for providing a threshold step on the floodgate side in addition to installation of the flap gate.

In order to solve such technical problem in refurbishment to provide a flap gate, the present applicant has developed a flap gate that enables a door to be largely lifted up by weight of an external float disposed on the outer water side relative to the door in a floodgate with no threshold step and that enables the door to be smoothly closed by buoyancy generated along with a rise in water level and obtained a patent right for the flap gate (Patent Literature 2) before.

CITATION LIST

Patent Literature

Patent Literature 1: Japanese Patent No. 3500388
Patent Literature 2: Japanese Patent No. 5905152

SUMMARY OF INVENTION

Technical Problem

However, in the invention described in Patent Literature 2, also, there may be cases where disposition of an external float is difficult because of, e.g., an installation site and/or an ambient environment of the floodgate and/or a structure of the floodgate. Therefore, there is a need to develop a new flap gate that can be installed even in a case where no threshold step is provided and disposition of an external float is difficult.

The present invention has been made in order to solve the aforementioned problems and an object of the present invention is to provide a watertight structure for a flap gate, the watertight structure being capable of, in a state in which no external force other than gravity is applied, providing a large gap between a door and a bottom face of a floodgate opening portion without providing a threshold step and being capable of ensuring watertightness between the door and the floodgate opening portion when the door is closed, and a flap gate including the watertight structure.

Solution to Problem

In order to solve the problem of providing a gap between a door and a bottom face of a floodgate opening portion without providing a threshold step and ensuring watertightness between the door and the floodgate opening portion when the door is closed, a watertight structure for a flap gate according to the present invention is a watertight structure for a flap gate including a door, the door being supported in a weight balance in which the door opens an opening portion of a floodgate in a state in which no external force other than gravity is applied, the watertight structure including: a gap opening-closing member that provides a gap between a lower edge of the door and a bottom face of the floodgate in a state in which the door closes the floodgate, and opens and closes the gap by swinging in a water flow direction; and opening operation assist means for operating the gap opening-closing member into an open state by lifting up the gap opening-closing member to an outer water side.

Also, as an aspect of the present invention, in order to solve the problem of automatically performing an operation of closing a gap opening-closing member held in an open state, using buoyancy, the watertight structure for a flap gate may include closing operation assist means for operating the gap opening-closing member held in an open state by the opening operation assist means into a closed state by buoyancy generated when submerged in water.

Furthermore, as an aspect of the present invention, in order to solve the problem of holding a gap opening-closing member in an open state via an assist arm provided in the gap opening-closing member, the opening operation assist means may include an assist arm that is fixed to a lower surface of the gap opening-closing member and that extends to an inner water side relative to the gap opening-closing member, and an open state holding weight that is disposed at an inner water-side end portion of the assist arm and that brings the gap opening-closing member into an open state by lifting up the gap opening-closing member to the outer water side via a weight balance.

Also, as an aspect of the present invention, in order to solve the problem of enhancing watertightness performance of a gap opening-closing member in a closed state, the closing operation assist means may include a close-contact float (or press-contact float) that is disposed at the inner water-side end portion of the assist arm and that brings the gap opening-closing member into close contact (or press-contact) with a doorstop of the floodgate opening portion by pulling the gap opening-closing member to the inner water side by buoyancy generated when submerged in water.

Furthermore, as an aspect of the present invention, in order to solve the problem of enhancing watertightness performance of a gap opening-closing member in a closed state, the closing operation assist means may include a connection member including an end connected to the inner water-side end portion of the assist arm, and a close-contact float (or press-contact float) that is connected to another end of the connection member, that is provided on an inner water-side surface of the door in such a manner as to be capable of moving upward and downward and that along with a rise due to buoyancy generated when submerged in water, lifts up the inner water-side end portion of the assist arm to pull the gap opening-closing member to the inner water side and thereby bring the gap opening-closing member into close contact (or press-contact) with a doorstop of the floodgate opening portion.

Also, as an aspect of the present invention, in order to solve the problem of holding a gap opening-closing member in an open state via a lifting weight that is provided for the gap opening-closing member and that is capable of moving upward and downward, the opening operation assist means may include a lifting weight capable of moving upward and downward, and a lift-up operation section that operates the gap opening-closing member into an open state by lifting up the gap opening-closing member to the outer water side via a direction conversion mechanism that converts tension in a gravity direction generated by self-weight of the lifting weight into a force in a lift-up direction.

Furthermore, as an aspect of the present invention, in order to solve the problem of making it easy to bring a gap opening-closing member held in an open state into a closed state by buoyancy, the lifting weight may have a floating function that makes the lifting weight rise by buoyancy generated when submerged in water along with a rise in water level.

Also, as an aspect of the present invention, in order to solve the problem of holding a gap opening-closing member in an open state via a lifting weight that is provided for the gap opening-closing member and that is capable of moving upward and downward, the lift-up operation section may include a seesaw portion that is swingably supported and that includes an end portion at which the lifting weight is provided, and a lift-up connection portion that connects another end portion of the seesaw portion and the gap opening-closing member and that lifts up the gap opening-closing member to the outer water side.

Furthermore, as an aspect of the present invention, in order to solve the problem of enhancing watertightness performance of a gap opening-closing member in a closed state, the lift-up connection portion may include a rigid body and further function as closing operation assist means for operating the gap opening-closing member into a closed state by buoyancy of the lifting weights generated when submerged in water.

In order to solve the problem of providing a gap between a door and a bottom face of a floodgate opening portion without providing a threshold step and ensuring watertightness between the door and the floodgate opening portion when the door is closed, a flap gate according to the present invention is a flap gate including a door supported in a weight balance in which the door opens an opening portion of a floodgate in a state in which no external force other than gravity is applied, wherein the door includes the watertight structure for a flap gate.

Also, as an aspect of the present invention, in order to solve the problem of ensuring watertightness performance of a door when closed, a gap opening-closing member receiving portion that is to be in abutment with the gap opening-closing member may be provided at each of lower end corner portions of right and left side doorstop portions of a doorstop of the flap gate.

Furthermore, as an aspect of the present invention, in order to solve the problem of curbing damage of a gap opening-closing member where running water such as a flash flood surges from the outer water side, a swing portion damage preventing portion that is formed in such a manner as to extend to the outer water side continuously along an upper surface of a lower doorstop portion and that includes an upper surface that is flat and smooth may be provided in a doorstop of the flap gate.

Advantageous Effects of Invention

The present invention enables, in a state in which no external force other than gravity is applied, providing a large gap between a door and a bottom face of a floodgate opening portion without providing a threshold step and ensures watertightness between the door and the floodgate opening portion when the door is closed.

DESCRIPTION OF EMBODIMENTS

A first embodiment of a watertight structure for a flap gate and a flap gate including the watertight structure according to the present invention will be described below with reference to the drawings.

Figure 1:
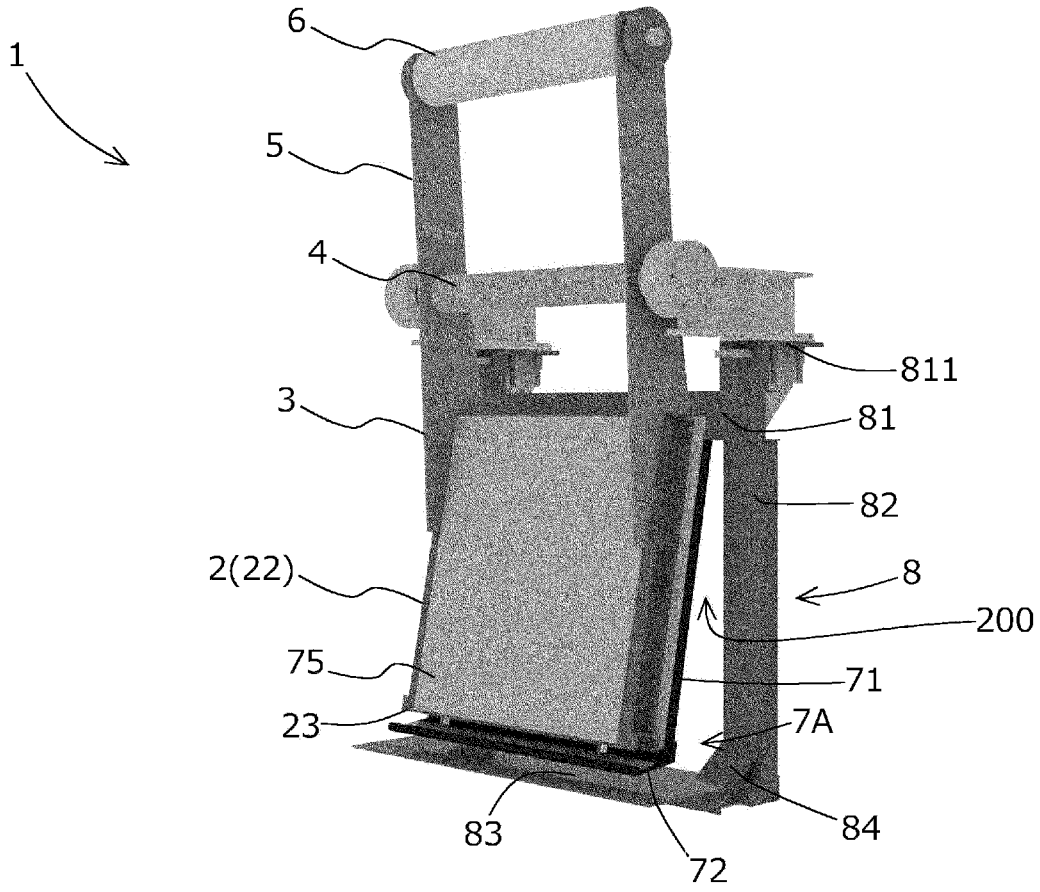
FIG. 1 is a front-side perspective view illustrating a first embodiment of a flap gate according to the present invention.
Figure 2:
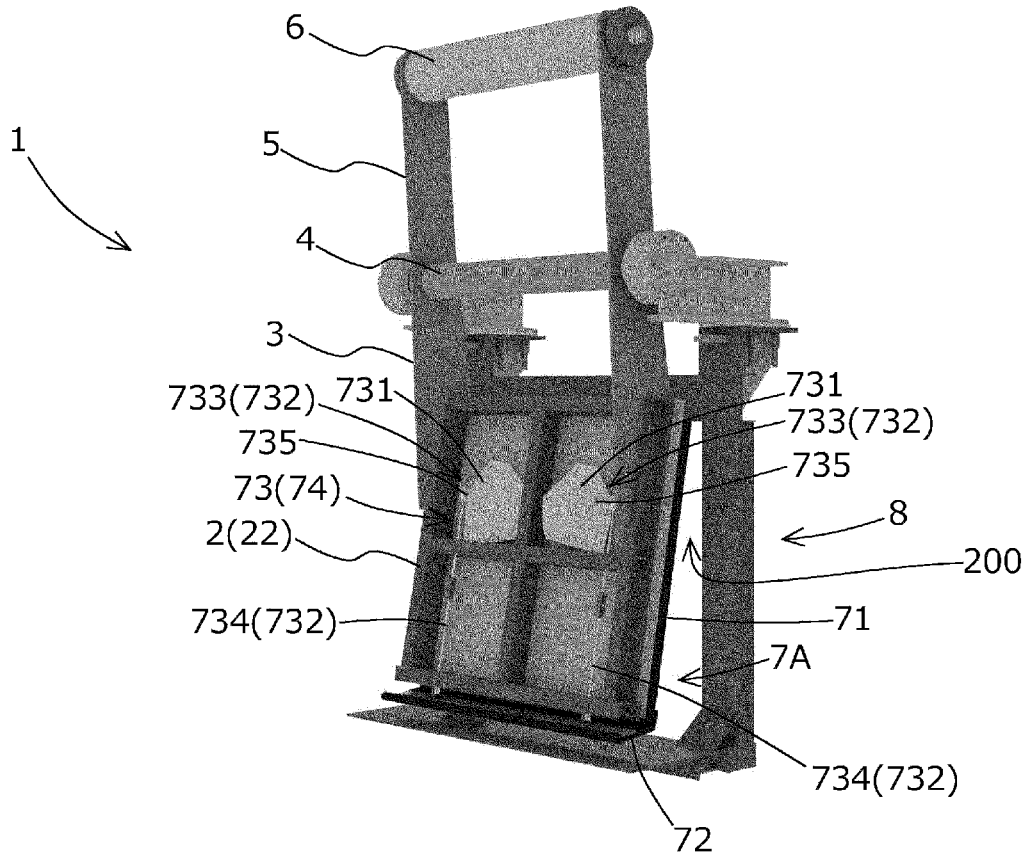
FIG. 2 is a front-side perspective view illustrating the flap gate of the first embodiment with a protective cover removed.
Figure 3:
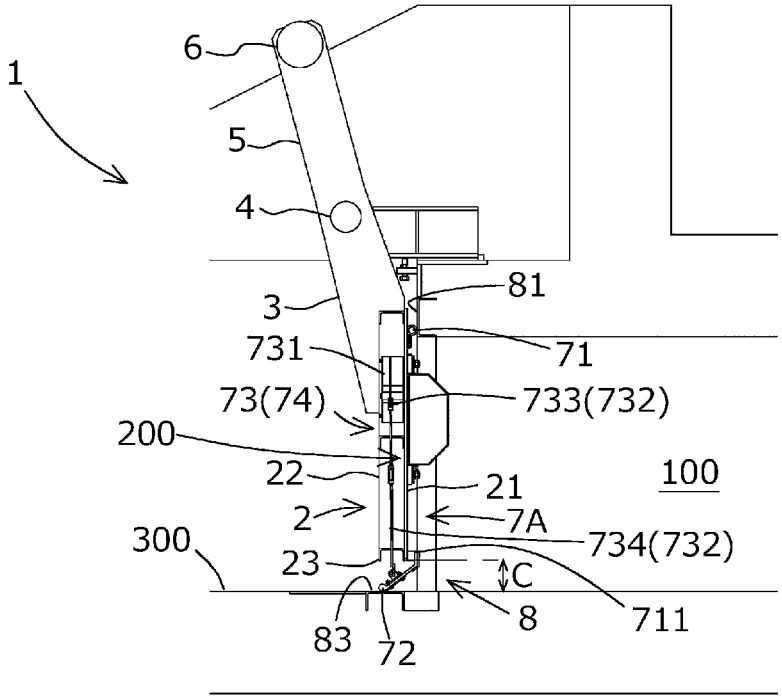
FIG. 3 is a side sectional view illustrating the flap gate of the first embodiment with an opening portion of a floodgate closed.

A flap gate 1 of the first embodiment is intended to automatically open and close an opening portion 200 of a floodgate 100 via a weight balance of a pivotally-supported door and water pressure, and as illustrated in FIGS. 1 to 3, includes a door 2 that opens and closes the opening portion 200, door support arms 3 that support the door 2, a swing support shaft 4 that connects the door support arms 3 and that swingably supports the door 2, weight arms 5 connected to the swing support shaft 4, a balancing weight 6 provided at upper ends of the weight arms 5, a watertight structure for a flap gate 7A ensuring watertightness between the door 2 and a doorstop 8, and the doorstop 8 disposed at the opening portion 200 of the floodgate 100. The respective components will be described in detail below.

The door 2 is a door that opens and closes the opening portion 200 of the floodgate 100, and in the first embodiment, has a rectangular shape in conformity to a shape of the opening portion 200. In order to be capable of closing the opening portion 200, the door 2 is larger in lateral width than the opening portion 200. The upper end side of the door 2 is supported in such a manner as to be located on the upper side relative to an upper edge of the opening portion 200 in a state in which the door 2 closes the opening portion 200. On the other hand, as illustrated in FIG. 3, the lower end side of the door 2 is supported in such a manner that a gap C is provided between a bottom face 300 of the floodgate 100 and the lower end side in a state in which the door 2 closes the opening portion 200.

The door support arms 3 are arms that support the door 2, and in the first embodiment, two door support arms 3, 3 are provided in such a manner as to extend upward continuously from an outer water-side surface 22 of the door 2.

The swing support shaft 4 is a shaft for swingably supporting the door 2 in a water flow direction, and in the first embodiment, is pivotally provided on bearings disposed above the floodgate opening portion 200. The door support arms 3 are fixed to the swing support shaft 4 and the swing support shaft 4 swingably supports the door 2 supported by the door support arms 3.

The weight arms 5 are arms for disposing the balancing weight 6 at the ends thereof, and in the first embodiment, extend to the side opposite to the door support arms 3 with the swing support shaft 4 as a base point.

The balancing weight 6 is intended to adjust a weight balance for setting an initial opening angle of the door 2 and is disposed at the upper ends of the weight arms 5. The balancing weight 6 in the first embodiment is adjusted to have weight that allows the door 2 to be balanced with an initial opening angle of 10 degrees. Here, the "initial opening angle" is an angle of the door 2 relative to the doorstop 8 when the door 2 is balanced in a state in which no external force other than gravity is applied. As a result of the initial opening angle being set, in normal time in which a water level on the outer water side is low and no backflow toward the inner water side occurs, a gap c provided between a lower edge of a later-described gap opening-closing member 72 and the bottom face 300 of the floodgate 100 is widened to allow water to be drained from the inner water side. Note that the initial opening angle is not specifically limited but is preferably around 5 to 20 degrees, more preferably 8 to 15 degrees according to, e.g., a shape of the gap opening-closing member 72, an amount of water drained from the inner water side and/or a water level during water drainage, and in the first embodiment, is set as 10 degrees.

Note that the weight balance for supporting the door 2 may be adjusted to be a weight balance for opening the opening portion of the floodgate according to a positional relationship between a gravity center position and a supported position of the door 2 without using the balancing weight 6.

The watertight structure for a flap gate 7A is intended to ensure watertightness by being in close contact with the doorstop 8 disposed at the floodgate opening portion 200 when the floodgate opening portion 200 is closed. As illustrated in FIGS. 1 to 4, the watertight structure for a flap gate 7A of the first embodiment includes a frame portion 71 formed in a frame-like shape along an outer peripheral edge of an inner water-side surface 21 of the door 2, the gap opening-closing member 72 that opens and closes the gap C provided between a lower edge 23 of the door 2 and the bottom face 300 of the floodgate 100, opening operation assist means 73 for operating the gap opening-closing member 72 into an open stated by lifting up the gap opening-closing member 72 to the outer water side, and closing operation assist means 74 for operating the gap opening-closing member 72 held in an open state by the opening operation assist means 73 into a closed state by buoyancy generated when submerged in water.

Figure 4:
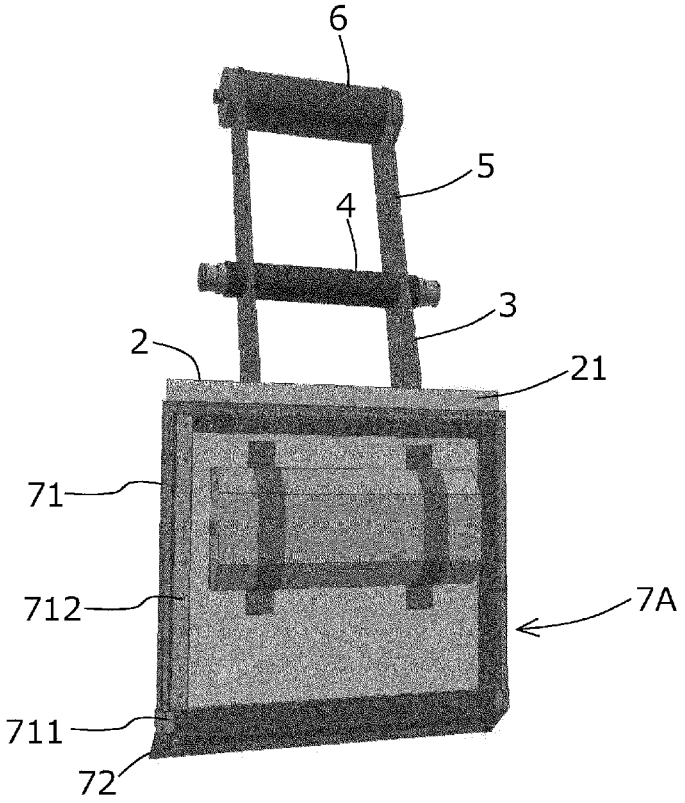
FIG. 4 is a perspective view illustrating a door in the first embodiment as viewed from the inner water side.

The frame portion 71 is mainly intended to ensure watertightness between the frame portion 71 and an upper end portion and right and left end portions of the floodgate opening portion 200 by coming into close contact with an upper doorstop portion 81 and right and left side doorstop portions 82, 82 of the doorstop 8. As illustrated in FIG. 4, the frame portion 71 in the first embodiment is formed in a rectangular frame-like shape along the outer peripheral edge of the inner water-side surface 21 of the door 2. An upper portion and right and left side portions of the frame portion 71 each are formed by what is called P-shape rubber having a P-shape in section, in order to ensure watertightness by coming into close contact with the upper doorstop portion 81 and the right and left side doorstop portions 82. Also, a lower portion of the frame portion 71 is configured as a fixing portion 711 to which the gap opening-closing member 72 is fixed, and is formed horizontally along the lower edge of the door 2. The frame portion 71 includes a plurality of bolt holes 712 and is fastened and fixed to the inner water-side surface 21 of the door 2 using bolts and nuts.

The gap opening-closing member 72 is intended to open and close the gap C provided between the lower edge 23 of the door 2 and the bottom face 300 of the floodgate 100 when the opening portion 200 is closed. As illustrated in FIG. 3, the gap opening-closing member 72 in the first embodiment is formed in such a manner as to extend downward from a lower edge of the frame portion 71. Therefore, the gap opening-closing member 72 is disposed at the lower edge 23 of the door 2 when the frame portion 71 is fixed to the door 2. The gap opening-closing member 72 is configured to be capable of, upon reception of an external force such as water pressure, swinging in the water flow direction with the frame portion 71 side as a base point via its own elastic force.

The gap opening-closing member 72 is mainly configured by natural rubber or synthetic rubber and is preferably configured by a rubber material obtained by appropriately adding or mixing, e.g., a carbon material or a fibrous material into natural rubber or synthetic rubber. However, the material of the gap opening-closing member 72 is not limited to these examples but can appropriately be selected from flexible and elastic materials capable of ensuring watertightness by coming into close contact with the doorstop 8. Also, the gap opening-closing member 72 does not necessarily need to be elastically deformable and only needs to enable operations of opening and closing the gap C via the opening operation assist means 73 and the closing operation assist means 74.

Note that the gap opening-closing member 72 may be a component that is integral to and continuous with the frame portion 71 using a same material or may be formed as a material that is separate from the frame portion 71 irrespective of whether a same material or a different material is used and be integrated with the frame portion 71 by combining the gap opening-closing member 72 and the frame portion 71 via fastening and fixing using, e.g., bolts and nuts or bonding and fixing using an adhesive. Also, although not illustrated, the gap opening-closing member 72 may be configured to be capable of swinging in the water flow direction by provision of, e.g., a hinge at the base point on the frame portion 71 side. Furthermore, in a state in which no external force other than gravity is applied, the gap opening-closing member 72 may have an elastic force that enables the gap opening-closing member 72 to be held in an open state in which the gap opening-closing member 72 is opened to the outer water side.

The opening operation assist means 73 is intended to operate the gap opening-closing member 72 into an open state by lifting up the gap opening-closing member 72 to the outer water side. The opening operation assist means 73 in the first embodiment includes lifting weights 731 capable of moving upward and downward, and lift-up operation sections 732 that operate the gap opening-closing member 72 into an open state by lifting up the gap opening-closing member 72 to the outer water side via respective direction conversion mechanisms that convert tension in the gravity direction generated by self-weight of the lifting weights 731 into forces in a lift-up direction.

The lifting weights 731 are weights capable of moving upward and downward relative to the door 2, and in the first embodiment, as illustrated in FIG. 2, two lifting weight 731 are arranged bilaterally symmetrically on the outer water surface side of the door 2. Each lifting weight 731 in the first embodiment has a floating function that makes the lifting weight 731 rise by buoyancy generated when submerged in water along with a rise in water level. More specifically, each lifting weight 731 is configured by an exterior material formed in a hollow box shape using a steel plate and an interior material received inside the exterior material and formed of, e.g., foamed polystyrene that makes it easy to generate buoyancy when submerged in water. Also, the lifting weights 731 are supported in such a manner as to be capable of moving upward and downward, by the respective lift-up operation sections 732, which will be described next.

Note that the shape of the lifting weights 731 is not specifically limited but may appropriately be selected from shapes that can rise and fall. Also, the number of lifting weights 731 disposed is not limited to two, but any appropriate number of lifting weights 731 disposed, the number being equal to or larger than one, may be selected as long as such number of lifting weights 731 disposed provide weight and buoyancy necessary for operations of opening or closing the gap opening-closing member 72.

Each lift-up operation section 732 is intended to convert tension in the gravity direction generated by the relevant lifting weight 731 into a force in the lift-up direction, and in the first embodiment, includes a seesaw portion 733 that functions as a direction conversion mechanism, and a lift-up connection portion 734 that connects the seesaw portion 733 and the gap opening-closing member 72.

Figure 5:
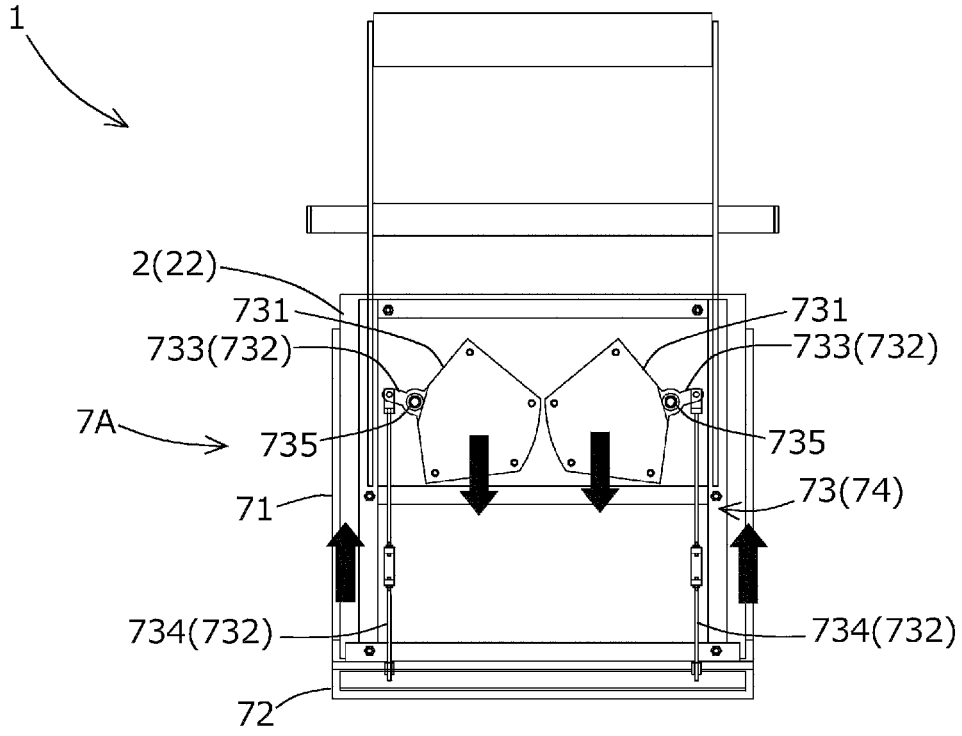
FIG. 5 is a front view illustrating a state in which a gap opening-closing member is operated into an open state by self-weight of lifting weights in the first embodiment.

The seesaw portion 733 is capable of swinging around a support shaft 735 provided perpendicularly to an outer side surface of the door 2 and includes one end portion with the lifting weight 731 fixed thereto. If no buoyancy is generated in the lifting weight 731, as illustrated in FIG. 5, the seesaw portion 733 is tilted to the side to which the lifting weight 731 is fixed, by the tension in the gravity direction generated by the self-weight of the lifting weight 731 and thereby lifts up the other end side.

The lift-up connection portion 734 connects the other end portion on the side opposite to the lifting weight 731 across the support shaft 735 of the seesaw portion 733, and the outer water side of the gap opening-closing member 72. In other words, the lift-up connection portion 734 transmits the tension in the gravity direction generated by the self-weight of the lifting weight 731 to the gap opening-closing member 72 via the seesaw portion 733 and thereby lifts up the gap opening-closing member 72.

Figure 6:
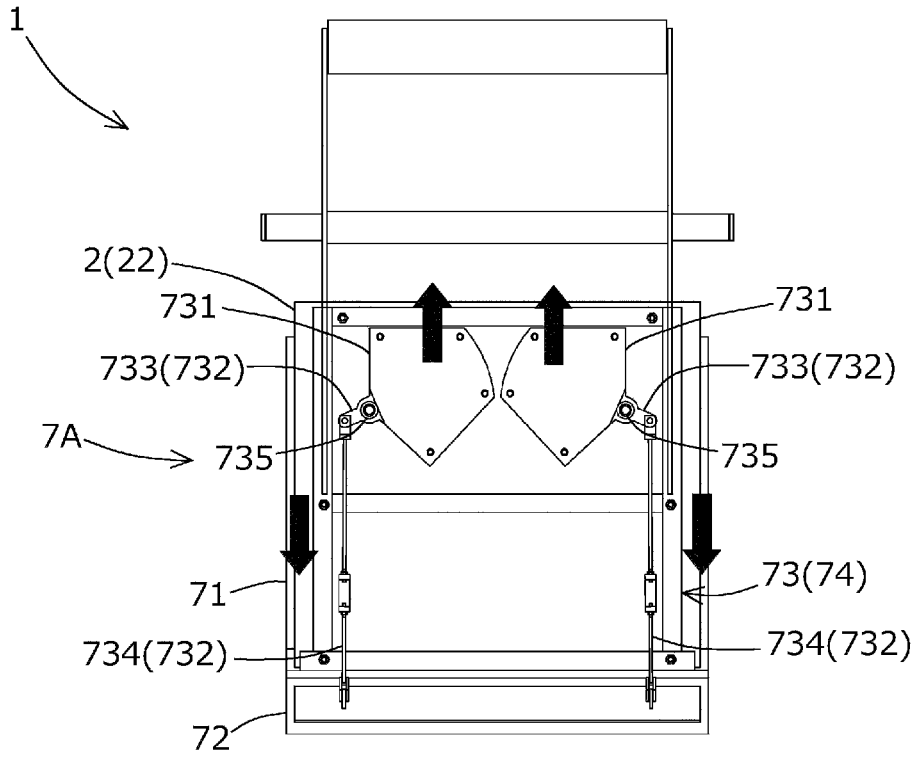
FIG. 6 is a front view illustrating a state in which the gap opening-closing member is operated into a closed state by buoyancy of the lifting weights generated when submerged in water in the first embodiment.

Also, the lift-up connection portions 734 in the first embodiment are each configured by a rigid body, and thus, the lifting weights 731 and the lift-up operation sections 732 also function as the closing operation assist means 74. The closing operation assist means 74 is intended to operate the gap opening-closing member 72 held in an open state by the opening operation assist means 73 into a closed state by buoyancy generated when submerged in water. In other words, in the first embodiment, as illustrated in FIG. 6, upon the lifting weight 731 side of each seesaw portion 733 rising because of buoyancy generated when the lifting weight 731 is submerged in water, the lift-up connection portion 734 side of the seesaw portion 733 falls. At this time, since the lift-up connection portions 734 are each configured by a rigid body having no flexibility, the buoyancy in each lifting weight 731 makes the gap opening-closing member 72 swing in a closing direction. Then, the gap opening-closing member 72 is pushed against the doorstop 8, enhancing watertightness between the gap opening-closing member 72 and the doorstop 8.

Also, in order to prevent, e.g., a weight balance from being lost because of adhesion of, e.g., floating substances and/or dust, as illustrated in FIG. 1, a protective cover 75 is provided on the lifting weights 731 and the lift-up operation sections 732 in the first embodiment on the outer water side of the door 2.

In the lifting weights 731 and the lift-up operation sections 732, where watertightness between the gap opening-closing member 72 and the doorstop 8 can be ensured by self-weight of the gap opening-closing member 72 and/or water pressure, the lift-up connection portion 734 may be configured by a flexible wire or rope.

Figure 7:
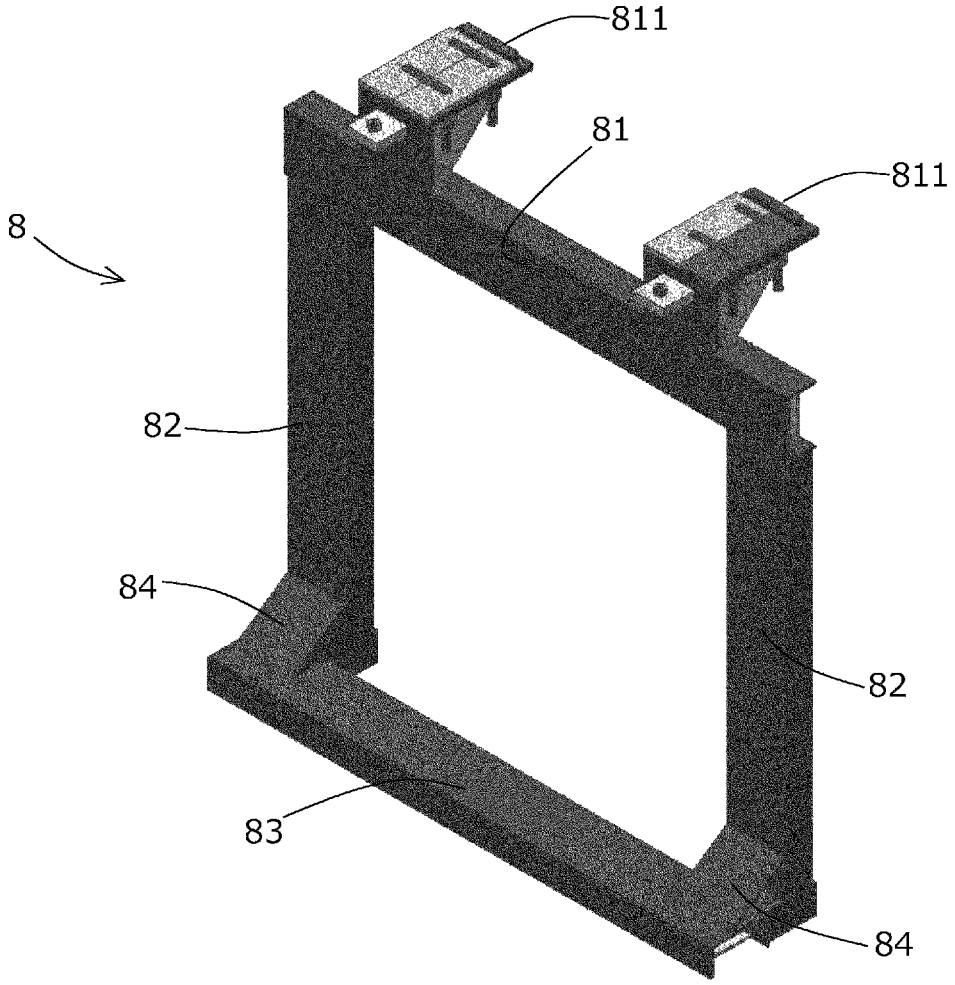
FIG. 7 is a perspective view illustrating a doorstop in the first embodiment.

The doorstop 8 is intended to ensure watertightness of the opening portion 200 by coming into close contact with the watertight structure for a flap gate 7A and is disposed at the opening portion 200. As illustrated in FIG. 7, the doorstop 8 in the first embodiment includes an upper doorstop portion 81 formed horizontally along an upper edge of the floodgate opening portion 200, right and left side doorstop portions 82 formed along right and left edge portions of the floodgate opening portion 200, respectively, a lower doorstop portion 83 that is formed along the bottom face 300 of the floodgate 100 and that extends to the outer water side from the right and left side doorstop portions 82, and gap opening-closing member receiving portions 84 provided in an inclined manner at lower end corner portions of the right and left side doorstop portions 82.

The upper doorstop portion 81 is to be in abutment with the upper portion of the frame portion 71 and the outer water surface side of the upper doorstop portion 81 is flat along a vertical plane in order to ensure watertightness. Also, bearing mounts 811 for disposing bearings for pivotally supporting the swing support shaft 4 are provided on an upper portion of the upper doorstop portion 81.

The side doorstop portions 82 are to be in abutment with the side portions of the frame portion 71 and are provided in such a manner as to extend downward from opposite, right and left, ends of the upper doorstop portion 81. As with the upper doorstop portion 81, the outer water surface sides of the side doorstop portions 82 are flat along the vertical plane in order to ensure watertightness.

The lower doorstop portion 83 is to be in abutment with a lower end of the gap opening-closing member 72 and is provided in such a manner as to extend horizontally from lower ends of the side doorstop portions 82 toward the outer water side. An upper surface of the lower doorstop portion 83 in the first embodiment is flat along a horizontal plane in order to ensure watertightness between the lower doorstop portion 83 and the lower end of the gap opening-closing member 72. Then, as illustrated in FIG. 3, the lower doorstop portion 83 is embedded in the bottom face 300 of the floodgate 100 in such a manner that the upper surface is exposed and has no level difference from the bottom face 300 of the floodgate 100.

The gap opening-closing member receiving portions 84 are to be in abutment with the gap opening-closing member 72, and more specifically, are to be in abutment with the inner water surface sides of opposite, right and left, ends of the gap opening-closing member 72. As illustrated in FIG. 7, the gap opening-closing member receiving portions 84 are provided in an inclined manner at the lower end corner portions of the right and left side doorstop portions 82. The gap opening-closing member receiving portions 84 in the first embodiment are inclined at a predetermined angle toward the outer water side relative to the respective side doorstop portions 82, and respective upper surfaces of the gap opening-closing member receiving portions 84 are flat.

Next, operation of the components in the first embodiment will be described.

In a state in which no external force other than gravity is applied, the door 2 is supported in such a manner as to be tilted at an angle corresponding to an initial opening angle, relative to the opening portion 200 of the floodgate 100 in a weight balance with the balancing weight 6.

Figure 8:
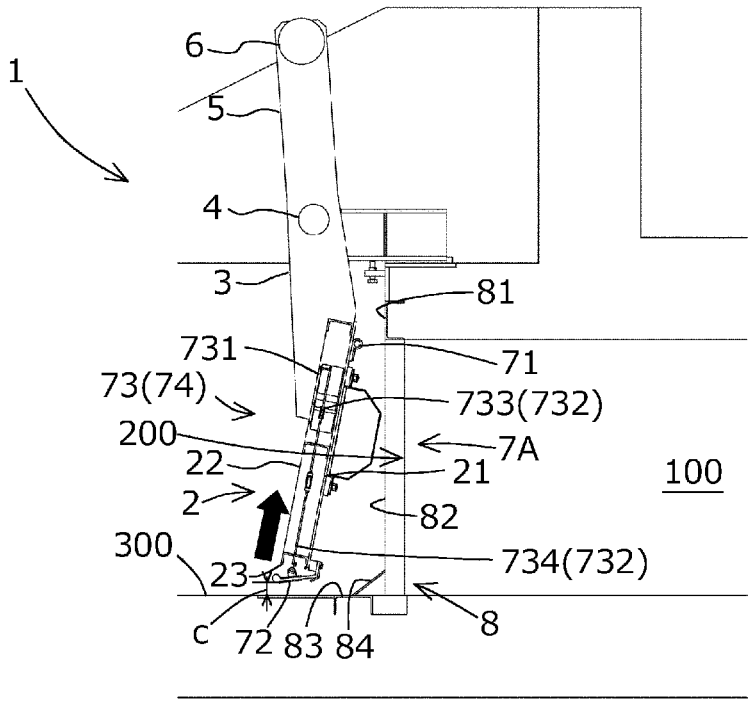
FIG. 8 is a side view illustrating a state in which the gap opening-closing member is operated into an open state by the self-weight of the lifting weights in the first embodiment.

At this time, as illustrated in FIGS. 5 and 8, the opening operation assist means 73 operates the gap opening-closing member 72 into an open state by lifting up the gap opening-closing member 72 to the outer water side. In other words, each lifting weight 731 generates tension in the gravity direction because of the self-weight. At this time, the seesaw portion 733 of each lift-up operation section 732 operates as the direction conversion mechanism and converts the tension in the gravity direction into a force in the lift-up direction. The force converted into the lift-up direction lifts up the gap opening-closing member 72 to the outer water side via the relevant lift-up connection portion 734.

Consequently, a large gap c can be kept between the gap opening-closing member 72 and the bottom face 300 of the floodgate 100 (lower doorstop portion 83), enabling smooth water drainage without providing a threshold step between the lower doorstop portion 83 and the bottom face 300 of the floodgate 100. Also, since no threshold step is provided, it is possible to prevent dirt, dust and the like flowing from the inner water side from being caught and accumulated.

Figure 9:
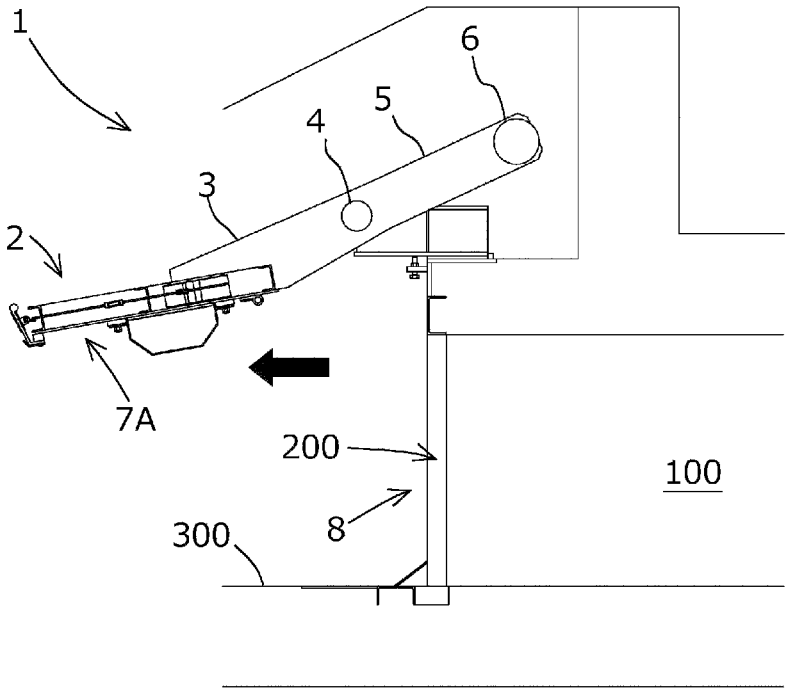
FIG. 9 is a side view illustrating a state in which the door in the first embodiment is largely opened by water pressure on the inner water side.

Next, if the water level on the inner water side rises and becomes higher than the lower end of the door 2, as illustrated in FIG. 9, the door 2 is pushed toward the outer water side by water pressure of drained water and the tilting angle of the door 2 thus becomes larger. At this time, the balancing weight 6 is located on the side opposite to the door 2 with the swing support shaft 4 as the base point, and where the tilting angle of the door 2 becomes larger, the balancing weight 6 is located on the inner water side relative to the swing support shaft 4, and thus, exerts torque in a direction in which the door 2 is opened. Therefore, in comparison with a case where the door 2 is solely supported, the tilting angle of the door 2 can be increased by small water pressure, which results in an increase in area of the opening and thus enables smooth water drainage.

Figure 10:
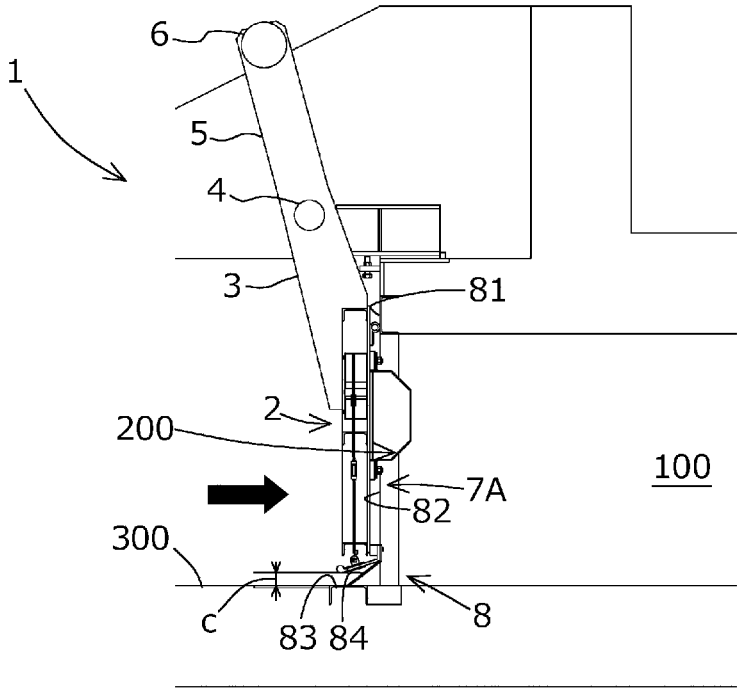
FIG. 10 is a side view illustrating a state in which the door in the first embodiment closes the floodgate via water pressure received from the outer water side.

On the other hand, if the water level on the outer water side rises and becomes higher than the water level on the inner water side, water reversely flows to the inner water side that is lower in water level. The door 2 is pushed toward the inner water side by water pressure of the reversely flowing water and as illustrated in FIG. 10, closes the floodgate opening portion 200. At this time, the frame portion 71 of the watertight structure for a flap gate 7A becomes into close contact with the upper doorstop portion 81 and the side doorstop portions 82. However, in this state, there is still the gap c between the lower end of the gap opening-closing member 72 and the lower doorstop portion 83 in the gap C between the lower edge 23 of the door 2 and the bottom face 300 of the floodgate 100, and thus, the water flows from the outer water side to the inner water side. Therefore, the gap opening-closing member 72 receives pressure of the water flowing through the gap c.

Figure 11:
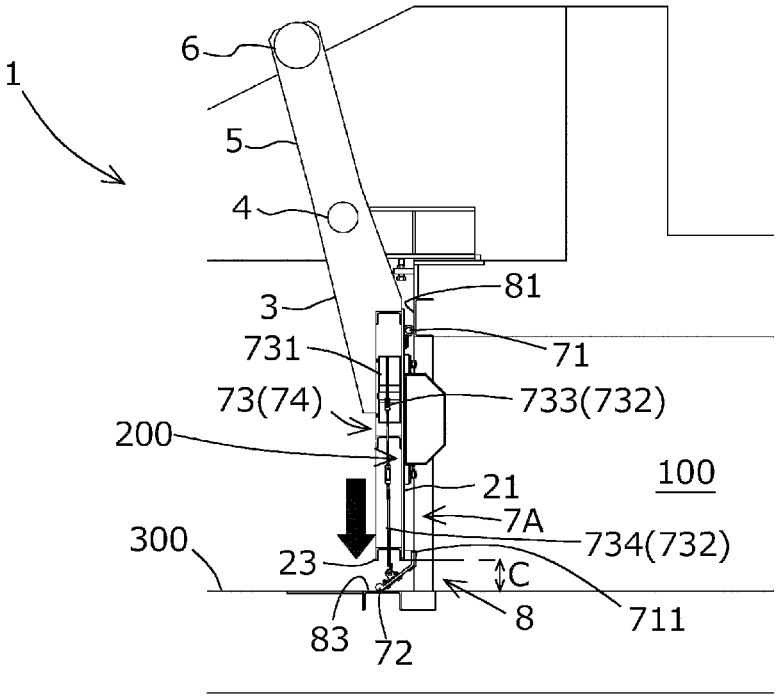
FIG. 11 is a side view illustrating a state in which the gap opening-closing member is operated into a closed state by buoyancy of the lifting weights generated when submerged in water in the first embodiment.

Also, the gap opening-closing member 72 is released from the force in the lift-up direction generated by buoyancy of the lifting weights 731 generated when submerged in water. Therefore, as illustrated in FIGS. 6 and 11, the gap opening-closing member 72 is pushed by the water pressure received from the outer water side and thereby swings to the inner water side. The lower end of the gap opening-closing member 72 swung to the doorstop 8 side comes into close contact with the lower doorstop portion 83. Also, the opposite, right and left, ends of the gap opening-closing member 72 come into close contact with the respective gap opening-closing member receiving portions 84. Consequently, the gap C between the lower edge 23 of the door 2 and the bottom face 300 of the floodgate 100 is closed and an entry of water from the outer water side to the inner water side is thus prevented.

Also, since the lift-up connection portions 734 in the first embodiment are each configured by a rigid body, the lifting weights 731 and the lift-up operation sections 732 function as the closing operation assist means 74. In other words, the buoyancy generated when submerged in water lifts up the lifting weight 731 side of each seesaw portion 733. Then, the seesaw portion 733 converts a force of lifting up the lifting weight 731 side into a force of pushing down the other end side. Here, since each lift-up connection portion 734 is configured by a rigid body, the pushing-down force is transmitted to the gap opening-closing member 72. The gap opening-closing member 72 is brought into close contact with the doorstop 8 by the pushing-down force, enabling enhancement in watertightness between the gap opening-closing member 72 and the doorstop 8.

The first embodiment above enables provision of the following effects.

1. In a state in which the gap opening-closing member 72 is lifted up to the outer water side by the opening operation assist means 73 and thereby opens the opening portion 200 of the floodgate 100, a large gap c (or clearance) can be formed between the gap opening-closing member 72 and the bottom face 300 of the floodgate 100, and thus, water can smoothly be drained from the inner water side to the outer water side.
2. When the floodgate opening portion 200 is automatically closed along with a rise in water level on the outer water side, the opening operation assist means 73 is released from the force of the opening operation assist means 73 being lifted up, the gap opening-closing member 72 is swung by water pressure and comes into close contact with the lower doorstop portion 83 and the gap opening-closing member receiving portions 84, enabling prevention of backflow to the inner water side.
3. Since the lift-up connection portions 734 are each configured by a rigid body, the lifting weights 731 and the lift-up operation sections 732 function as the closing operation assist means 74, and a force of pushing the gap opening-closing member 72 to the doorstop 8 side, the force being generated by buoyancy of the lifting weights 731 generated when submerged in water, enables enhancement in watertightness between the gap opening-closing member 72 and the doorstop 8.

Next, a second embodiment of the present invention will be described with reference to the drawings. Note that components that are identical or correspond to components described in the above first embodiment are provided with reference numerals that are the same as those of the first embodiments and repetitive description of such components is omitted.

Figure 12:
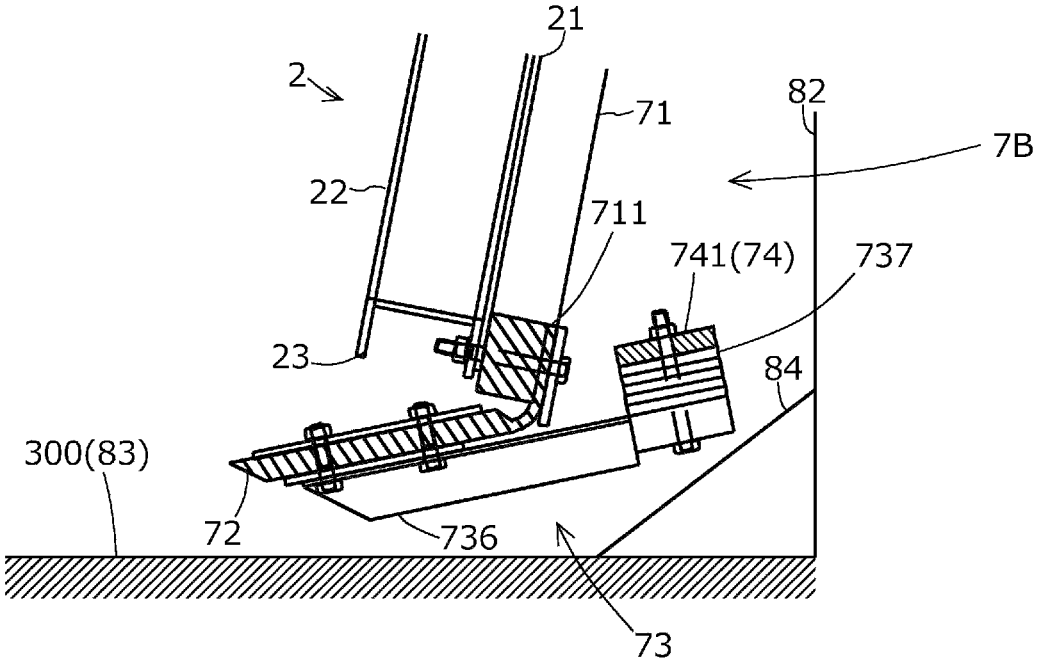
FIG. 12 is a side view illustrating a door and a gap opening-closing member in a second embodiment of the flap gate according to the present invention.

As illustrated in FIG. 12, a watertight structure for a flap gate 7B of the second embodiment includes assist arms 736 provided on a gap opening-closing member 72 and open state holding weights 737 disposed at inner water-side end portions of the assist arms 736 as opening operation assist means 73, and includes a close-contact float 741 as closing operation assist means 74.

Figure 13:
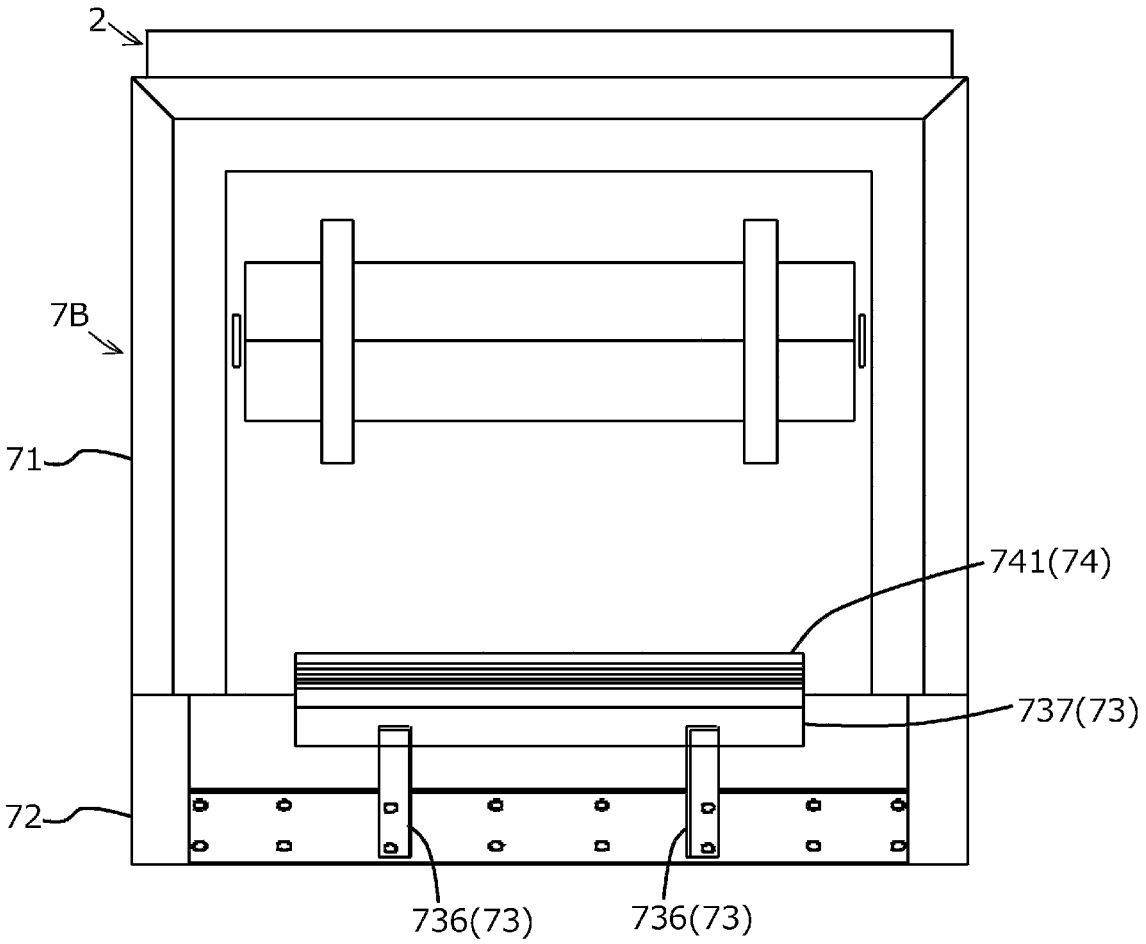
FIG. 13 is a back view illustrating the door and a watertight structure for a flap gate in the flap gate of the second embodiment.

Each assist arm 736 is an arm for operating the gap opening-closing member 72 into an open state by lifting up the gap opening-closing member 72 to the outer water side as a result of the open state holding weights 737 being disposed at the inner water-side end portion, and is fixed to a lower surface of the gap opening-closing member 72 and extends to the inner water side relative to the gap opening-closing member 72. As illustrated in FIGS. 12 and 13, the assist arms 736 in the second embodiment are formed of two L-shaped angle members having an L-shape in section and are disposed at respective positions that are bilaterally symmetrical to each other.

The open state holding weights 737 are disposed at the inner water-side end portions of the assist arms 736 and are intended to lift up the gap opening-closing member 72 to the outer water side via a force of pushing down the inner water-side end portions via self-weight of the open state holding weights 737. Each open state holding weight 737 in the second embodiment is formed in the shape of a plate having a length enough to bridge the assist arms 736, and an angle of the gap opening-closing member 72 lifted up to the outer water side can be adjusted by adjusting the number of open state holding weights 737 disposed at the inner water-side end portions of the assist arm 736. Note that, e.g., a shape and a material of the open state holding weights 737 are not specifically limited and may appropriately be changed or selected.

The close-contact float 741 is intended to pull the gap opening-closing member 72 to the inner water side and bring the gap opening-closing member 72 into close contact with a doorstop 8 of a floodgate opening portion 200 by lifting up the inner water-side end portions of the assist arms 736 by buoyancy generated when submerged in water. The close-contact float 741 is formed of a material that easily generates buoyancy when submerged in water such as foamed polystyrene, and in the second embodiment, as illustrated in FIGS. 12 and 13, is formed in the shape of a plane having a length enough to bridge the assist arms 736 provided on the right and left. Then, the close-contact float 741 is disposed at the inner water-side end portions of the assist arms 736, together with the open state holding weights 737.

Next, operation of the components in the second embodiment will be described.

Figure 14:
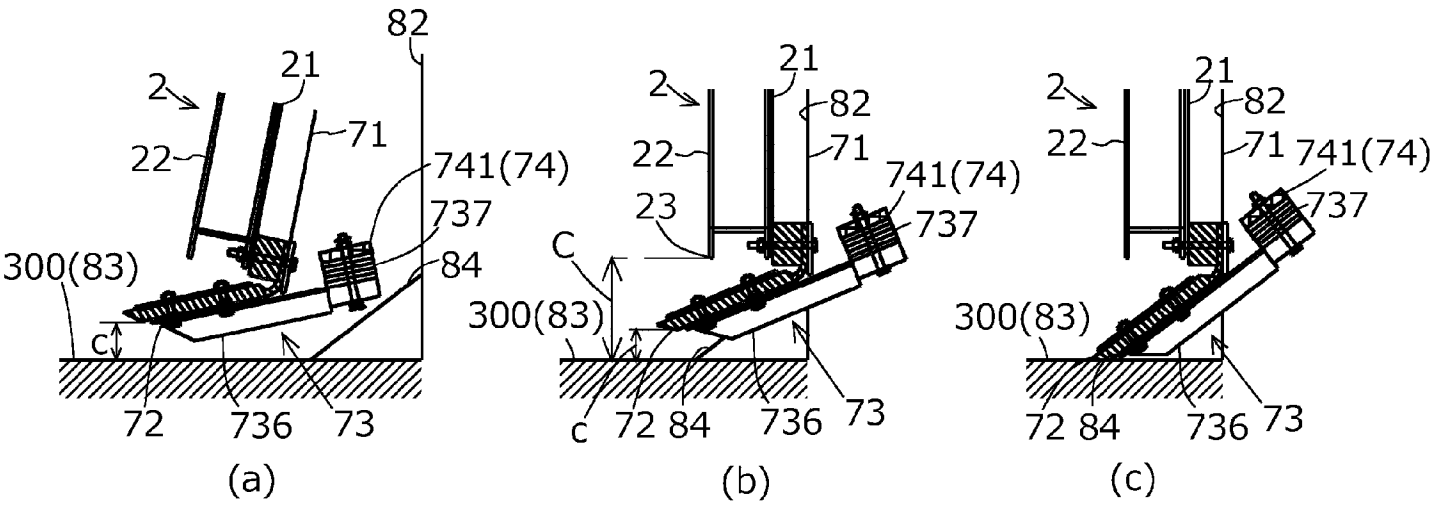
FIG. 14 include side views illustrating the flap gate of the second embodiment (a) in a state in which the door is tilted with an initial opening angle, (b) in a state in which the door is in close contact with a doorstop and (c) in a state in which the gap opening-closing member is in close contact with gap opening-closing member receiving portions.

As illustrated in FIG. 14(*a*), the gap opening-closing member 72 is held in a state in which the gap opening-closing member 72 is lifted up to the outer water side, in a weight balance with the assist arms 736 provided on the lower surface of the gap opening-closing member 72 and the open state holding weights 737 and the close-contact float 741 provided at the inner water-side end portions of the assist arms 736.

Where a water level on the outer water side rises and becomes higher than a water level on the inner water side, as illustrated in FIG. 14(*b*), the door 2 is pushed toward the inner water side by water pressure of reversely flowing water and thereby closes the floodgate opening portion 200. Then, the gap opening-closing member 72 receives the pressure of water flowing from the outer water side to the inner water side.

Also, where the water level in the inner water side rises and the close-contact float 741 is submerged in water, buoyancy is generated in the close-contact float 741. The buoyancy of the close-contact float 741 pulls the inner water-side end portions of the assist arms 736 upward.

As a result of the inner water-side end portions being pulled up, the assist arms 736 an outer water-side portion of the gap opening-closing member 72 is pulled downward. In other words, a force of swinging the gap opening-closing member 72 into a closed state is exerted.

The gap opening-closing member 72 is pushed to swing to the inner water side by the water pressure and the buoyancy of the close-contact float 741, and thereby comes into close contact with a lower doorstop portion 83 and gap opening-closing member receiving portions 84 and closes a gap C between a lower edge 23 of the door 2 and a bottom face 300 of a floodgate 100. At this time, the close-contact float 741 pulls the gap opening-closing member 72 to the inner water side by the buoyancy, and thus, a degree of the close contact between the gap opening-closing member 72 and the lower doorstop portion 83 and the gap opening-closing member receiving portions 84 is enhanced. When the door 2 is closed, a difference in water pressure between the inner water side and the outer water side decreases along with a rise in water level on the inner water side and the water pressure that pushes the gap opening-closing member 72 to the inner water side thus decreases; however, a decrease in degree of close contact can be compensated for by the buoyancy of the close-contact float 741.

According to the second embodiment above, the gap opening-closing member 72 can be lifted up to the outer water side by a weight balance between the open state holding weights 737 provided at the inner water-side end portions of the assist arms 736 and the gap opening-closing member 72. Also, the force of bringing the gap opening-closing member 72 into close contact with the lower doorstop portion 83 and the gap opening-closing member receiving portions 84 can be enhanced by the buoyancy of the close-contact float 741.

Next, a third embodiment of the present invention will be described with reference to the drawings. Note that components that are identical or correspond to components described in the first and second embodiments above are provided with reference numerals that are the same as those of the first and second embodiments and repetitive description of such components is omitted.

Figure 15:
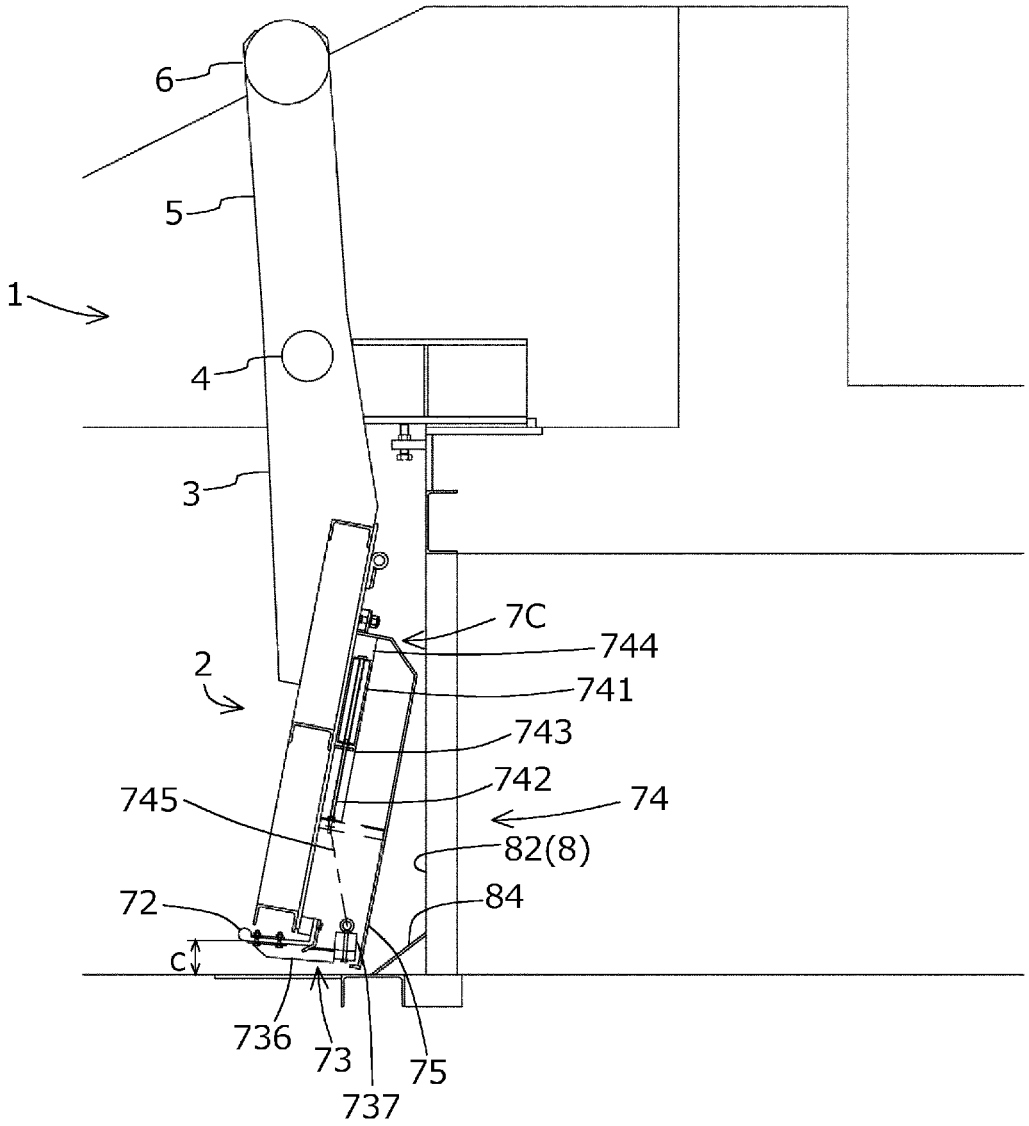
FIG. 15 is a right side view illustrating a third embodiment of the flap gate according to the present invention.
Figure 16:
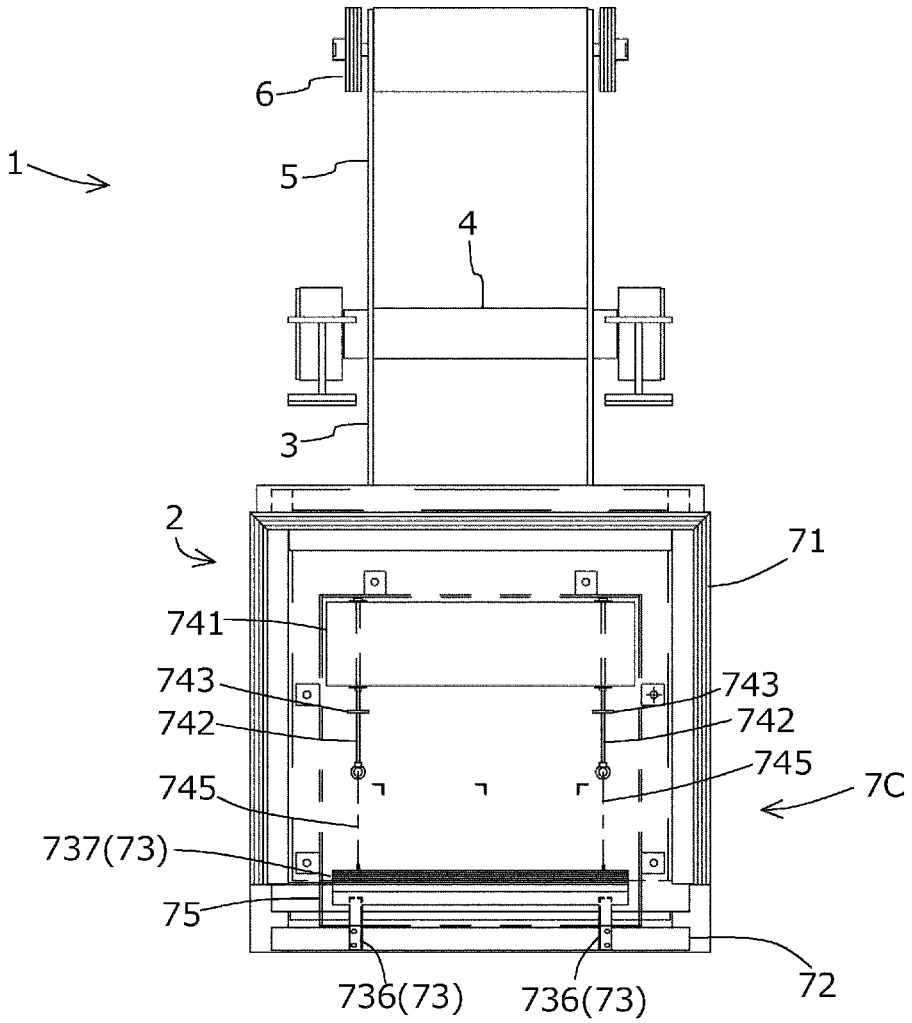
FIG. 16 is a back view illustrating the flap gate of the third embodiment (as viewed from the inner water side).

A watertight structure for a flap gate 7C of the third embodiment is different from that of the second embodiment in configuration of a close-contact float 741 in closing operation assist means 74. As illustrated in FIGS. 15 and 16, the close-contact float 741 in the third embodiment is provided in such a manner as to be capable of moving upward and downward on an inner water-side surface of a door 2.

More specifically, the close-contact float 741 is formed in a rectangular plate shape. As illustrated in FIG. 16, the rectangular close-contact float 741 is provided with a pair of sliding rod materials 742 at positions laterally symmetrical to each other in such a manner that the sliding rod materials 742 extend downward. On the other hand, slide support members 743 each including a hole having a size that enables the relevant sliding rod material 742 to be inserted therethrough are fixed to the inner water-side surface of the door 2, and each sliding rod material 742 is supported by the relevant slide support member 743 in such a manner as to be capable of sliding in an up-down direction.

Also, on the inner water surface side of the close-contact float 741, an inner water surface-side support plate 744 that supports the inner water surface side is disposed. A space formed between the inner water surface-side support plate 744 and the inner water-side surface of the door 2 is configured to be capable of being immersed with water, and along with a rise in water level on the inner water surface side of the door 2, a water level in the space also rises. In other words, the close-contact float 741 in the space is configured to be capable of rising by buoyancy generated along with a rise in water level on the inner water surface side of the door 2. The close-contact float 741 can be disposed at an arbitrary height on the inner water-side surface of the door 2, providing an advantage of being able to freely select a water level at which buoyancy is exerted.

Figure 17:
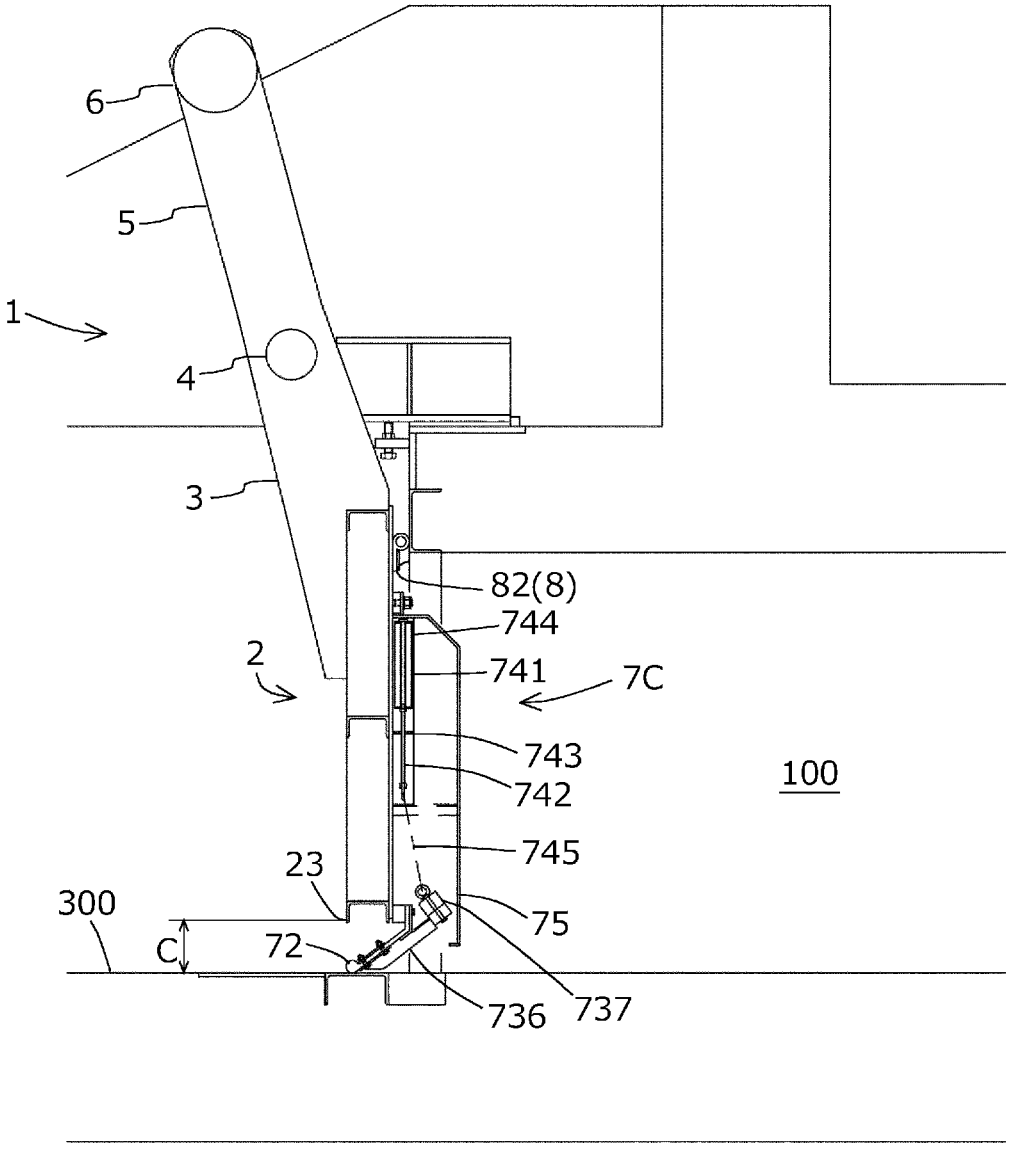
FIG. 17 is a right side view illustrating a state in which the door is closed in the flap gate of the third embodiment.

Also, the close-contact float 741 in the third embodiment is connected to inner water-side end portions of assist arms 736 by connection members 745. More specifically, each connection member 745 is formed of, e.g., a rope or a wire and includes an end to which the inner water-side end portion of the relevant assist arm 736 is connected and another end to which a lower end portion of the relevant sliding rod material 742 of the close-contact float 741 is connected. Then, in a state in which no buoyancy is generated in the close-contact float 741, each connection member 745 is connected in such a manner that no tension is applied to the inner water-side end portion of the relevant assist arm 736. On the other hand, upon a rise of the close-contact float 741 by buoyancy generated when submerged in water, tension is generated in the connection members 745, and as illustrated in FIG. 17, the connection members 745 pull up the inner water-side end portions of the respective assist arms 736.

Then, the closing operation assist means 74 in the third embodiment is provided with a protective cover 75 that covers the entire inner water surface side of the door 2 in order to prevent pull-up of the inner water-side end portions of the assist arms 736 from being hindered by dust flowing from the inner water side being caught by, e.g., the close-contact float 741, the connection members 745 and/or the assist arms 736.

According to the above third embodiment, as in the second embodiment, the inner water-side end portions of the assist arms 736 are pulled up by the buoyancy of the close-contact float 741, enabling enhancement of a force of bringing a gap opening-closing member 72 into close contact with a lower doorstop portion 83 and gap opening-closing member receiving portions 84.

Next, a fourth embodiment of the present invention will be described with reference to the drawings. Note that components that are identical or correspond to components described in the first to third embodiments above are provided with reference numerals that are the same as those of the first to third embodiments and repetitive description of such components is omitted.

Figure 18:
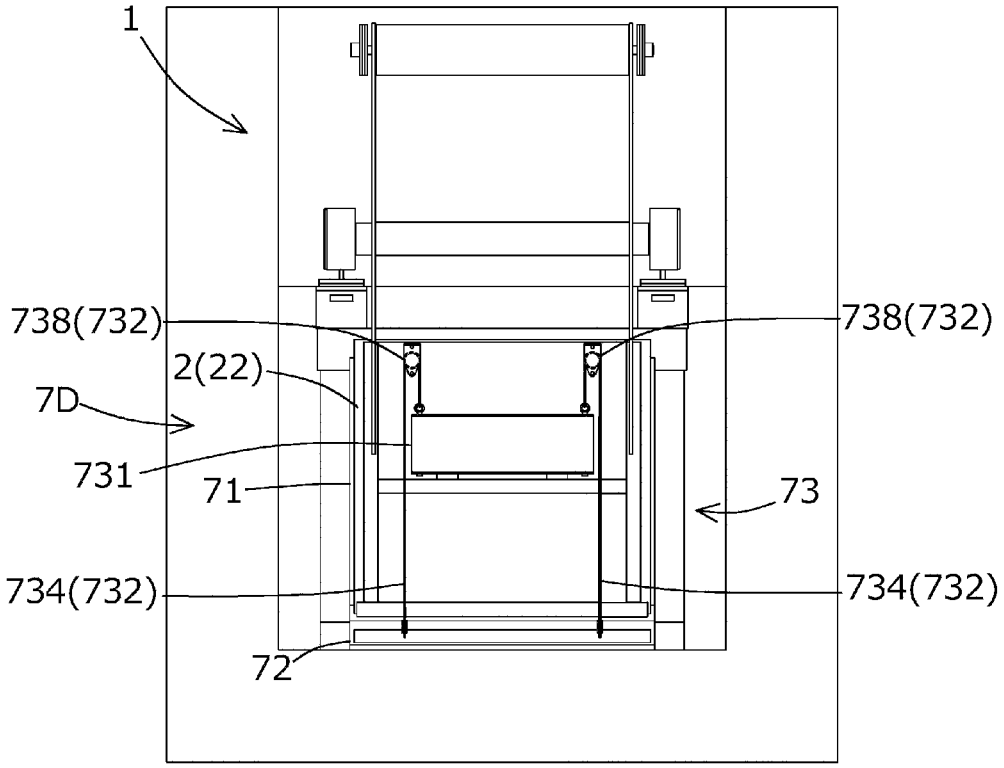
FIG. 18 is a front view illustrating a fourth embodiment of the flap gate according to the present invention.
Figure 19:
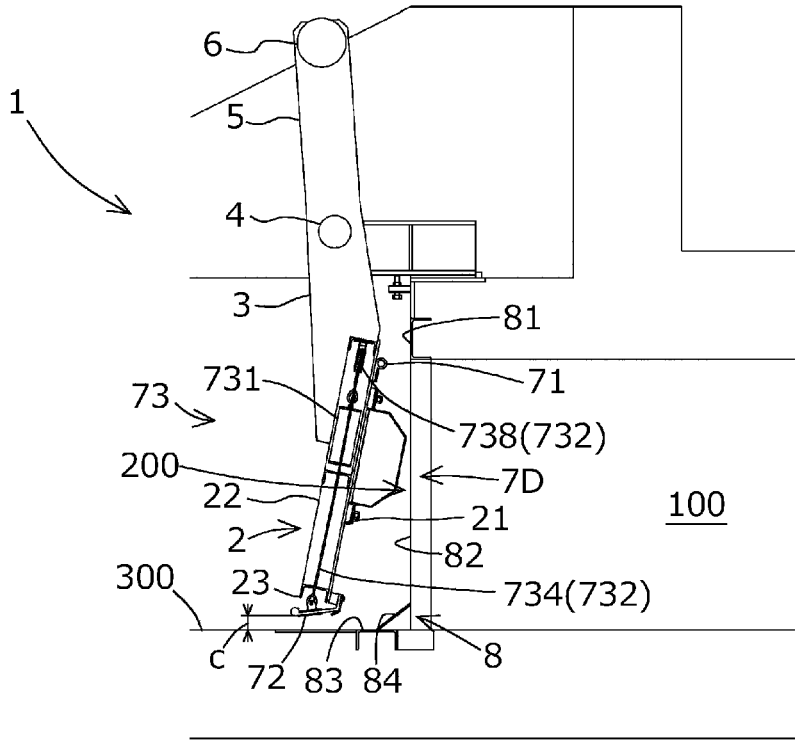
FIG. 19 is a side view illustrating the flap gate of the fourth embodiment.

As illustrated in FIGS. 18 and 19, a lifting weight 731 in the fourth embodiment is provided in such a manner as to be capable of moving upward and downward on an outer water-side surface of a door 2. Also, as with the lifting weights 731 of the first embodiment, the lifting weight 731 has a floating function that makes the lifting weight 731 rise by buoyancy generated when submerged in water along with a rise in water level.

Also, each of lift-up operation sections 732 in the fourth embodiment includes a pulley 738 that converts tension in a gravity direction generated by self-weight of the lifting weight 731 into a force in a pull-up direction, and a lift-up connection portion 734 that connects the lifting weight 731 and a gap opening-closing member 72. Each lift-up connection portion 734 in the fourth embodiment is configured by a flexible wire or rope.

According to the above fourth embodiment, where no buoyancy is generated in the lifting weight 731, tension in the gravity direction generated by the self-weight of the lifting weight 731 is converted into a force of lifting up the gap opening-closing member 72, by the pulleys 738, enabling operating the gap opening-closing member 72 into an open state by lifting up the gap opening-closing member 72 to the outer water side. Therefore, drainage of water flowing from the inner water side to the outer water side can be smoothed.

On the other hand, where the lifting weight 731 is submerged in water and buoyancy is thus generated, the gap opening-closing member 72 is released from the force of pulling up the gap opening-closing member 72 to the outer water side, and the gap opening-closing member 72 is swung to the doorstop 8 side by pressure of water flowing from the outer water side to the inner water side. Consequently, the gap opening-closing member 72 closes a gap C between a lower edge 23 of the door 2 and a bottom face 300 of a floodgate 100, enabling prevention of backflow to the inner water side.

Next, a fifth embodiment of the present invention will be described with reference to the drawings. Note that components that are identical or correspond to components described in the first to fourth embodiments above are provided with reference numerals that are the same as those of the first to fourth embodiments and repetitive description of such components is omitted.

Figure 20:
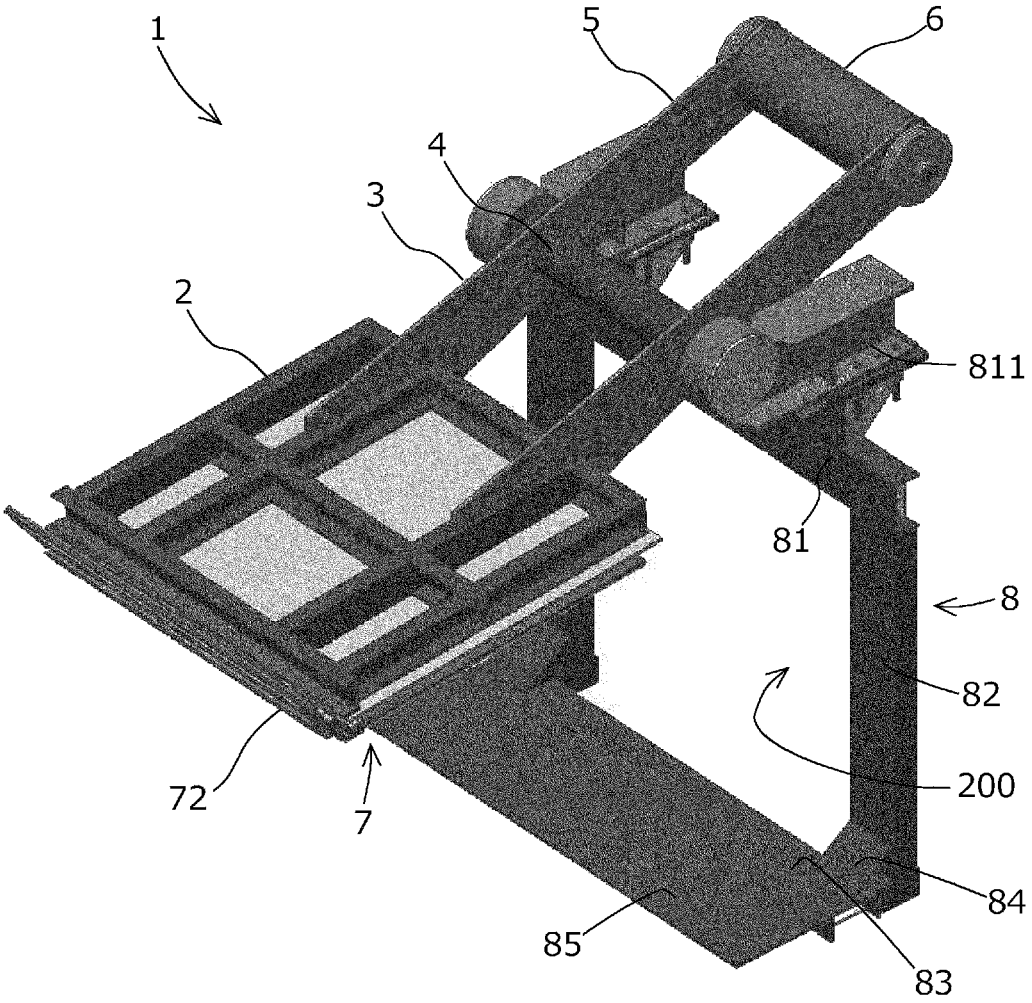
FIG. 20 is a perspective view illustrating a fifth embodiment of the flap gate according to the present invention.
Figure 21:
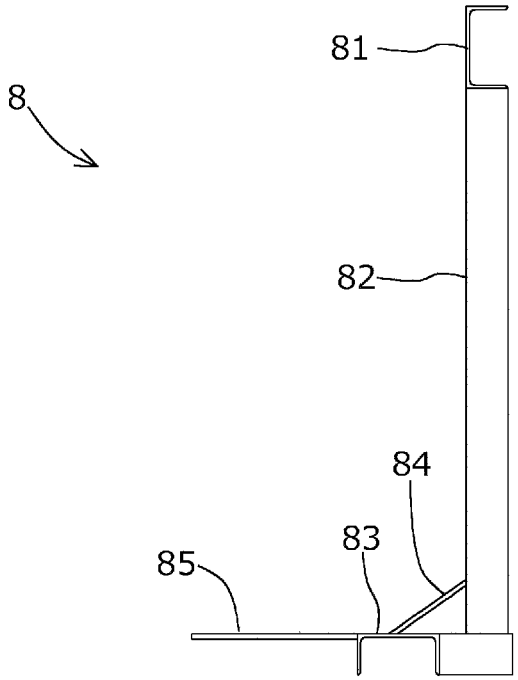
FIG. 21 is a right side view illustrating a doorstop in the fifth embodiment.

As illustrated in FIGS. 20 and 21, a doorstop 8 in the fifth embodiment includes a swing portion damage preventing portion 85 formed in such a manner as to extend from a lower doorstop portion 83 to the downstream side. The swing portion damage preventing portion 85 is intended to, if running water such as a flash flood surges from the inner water side and the outer water side, bring the swinging gap opening-closing member 72 into abutment with the swing portion damage preventing portion 85 prior to closure of the door 2. In general, a bottom face of a floodgate is configured by a coarse surface formed by placing, e.g., concrete, and thus, if a distal end of the gap opening-closing member 72 directly abuts on the bottom face and is thereby damaged, it becomes difficult to ensure watertightness. Therefore, provision of the swing portion damage preventing portion 85 prevents damage of the gap opening-closing member 72 if running water such as a flash flood surges.

As illustrated in FIG. 21, the swing portion damage preventing portion 85 in the fifth embodiment is formed in such a manner as to extend to the outer water side continuously along an upper surface of a lower doorstop portion so that an upper surface of the swing portion damage preventing portion 85 is substantially in plane with the upper surface of the lower doorstop portion. Also, as with the upper surface of the lower doorstop portion, the upper surface of the swing portion damage preventing portion 85 is flat and smooth.

According to the above fifth embodiment, even if the gap opening-closing member 72 swings prior to closure of the door 2, the distal end of the gap opening-closing member 72 comes into contact with the swing portion damage preventing portion 85 and thus can be prevented from being damaged.

Note that the present invention is not limited to the above-described embodiments and appropriate changes are possible. For example, a drive device such as a hydraulic cylinder that forcibly swings the door 2 may be provided in the flap gate 1.

Figure 22:
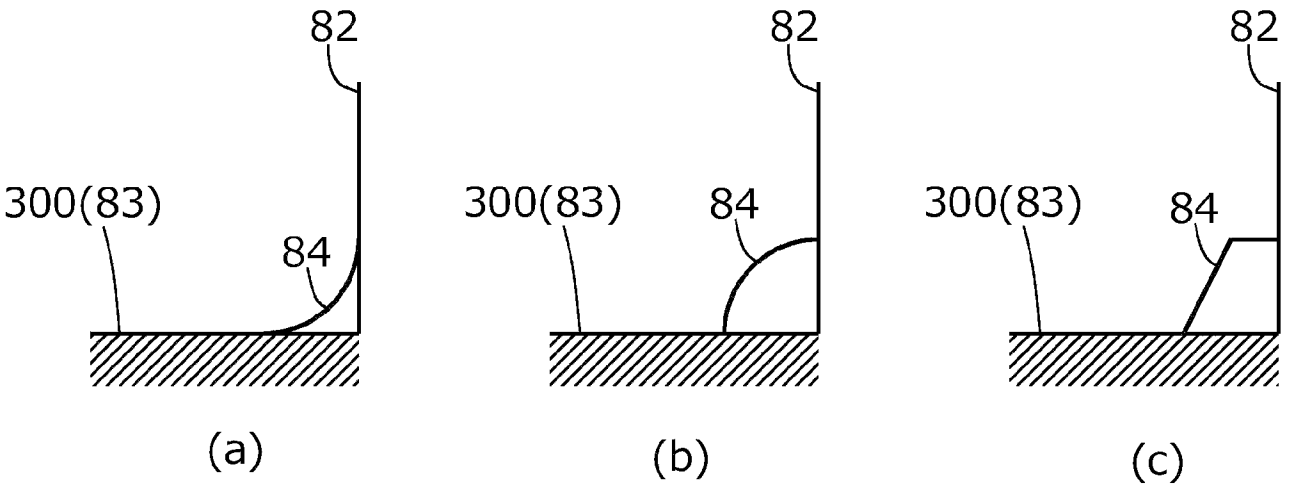
FIG. 22 includes right side views illustrating embodiments in which a gap opening-closing member receiving portion has (a) a recessed curve shape, (b) a projecting curve shape and (c) a stepped shape.

Also, the above-described gap opening-closing member receiving portions 84 are formed in the shape of an inclined planar surface, and in particular, the surface of each gap opening-closing member receiving portion 84, the surface coming into close contact with the gap opening-closing member 72, is a flat surface; however, the present invention is not limited to this example, but as long as the close contact with the gap opening-closing member 72 is ensured, the surface may arbitrarily be formed to be, for example, a recessed curve surface (FIG. 22(*a*)), a projecting curve surface (FIG. 22(*b*)) or a stepped surface (FIG. 22(*c*)). Also, although not illustrated, the close-contact surface of the gap opening-closing member 72 may be formed in a shape conforming to the shape of the gap opening-closing member receiving portions 84.

Figure 23:
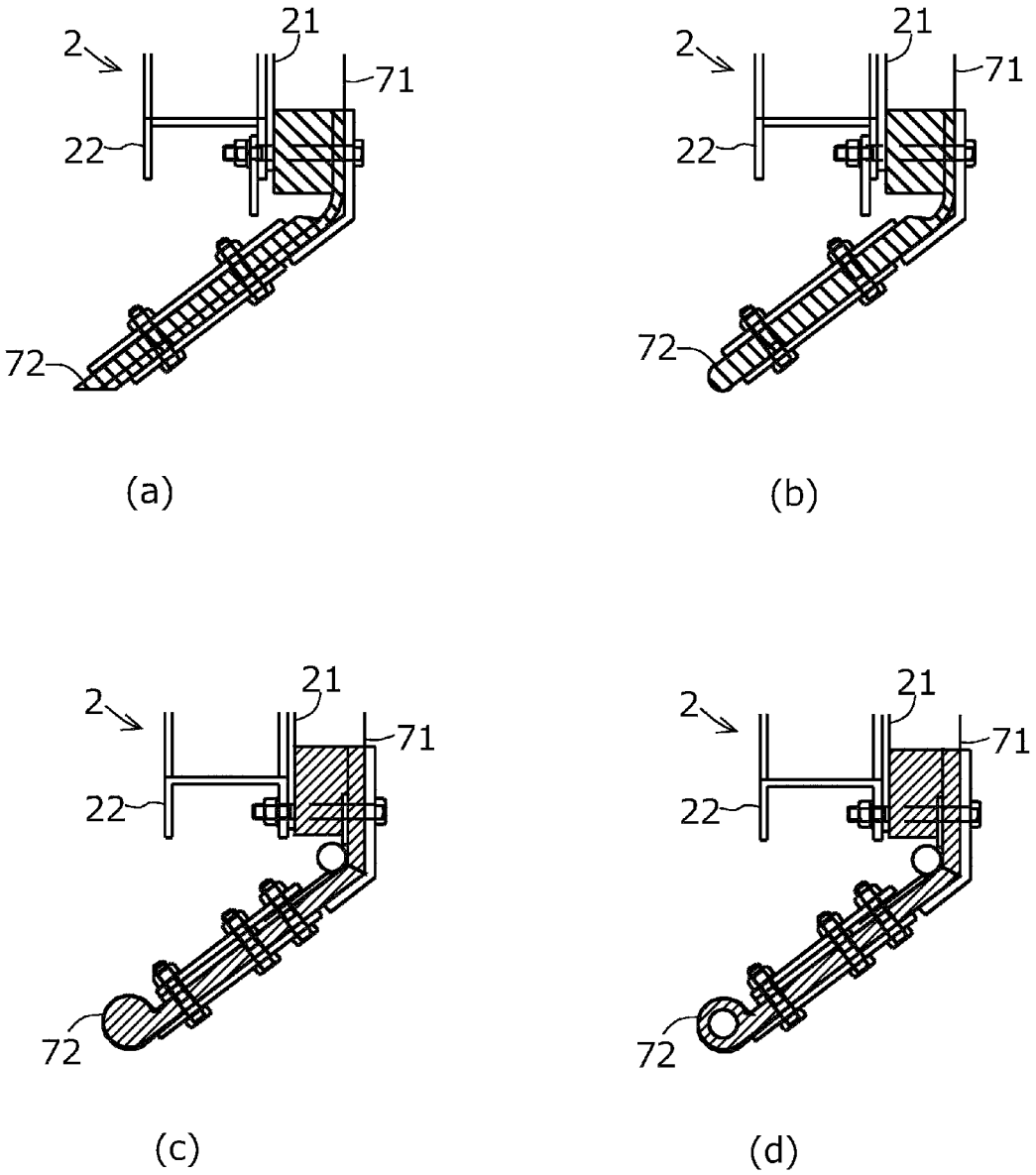
FIG. 23 includes right side views illustrating embodiments in which a distal end of a gap opening-closing member, the distal end being in contact with a lower doorstop portion, has (a) a planar shape, (b) an arc shape, (c) a bulging arc shape and (d) a hollow shape.

Furthermore, a shape of the distal end (lower end) of the gap opening-closing member 72, the distal end (lower end) coming into contact with the lower doorstop portion 83, may be a planar shape (FIG. 23(*a*)), an arc shape (FIG. 23(*b*)) or a bulging arc shape (FIG. 23(*c*)) so that when the door 2 is closed, the area of contact with the bottom face 300 of the floodgate 100 (lower doorstop portion 83) is enlarged or the inside of the distal end may be hollow (FIG. 23(*d*)) so that the area of contact is further enlarged by enhancement in elasticity.

Also, the present invention is not limited to a configuration in which either the closing operation assist means 74 in the second embodiment or the closing operation assist means 74 in the third embodiment is included but the both may be included. In other words, although not illustrated, both a close-contact float 741 directly attached to inner water-side end portions of assist arms 736 and a close-contact float 741 provided on the inner water surface side of a door 2 in such a manner as to be capable of moving upward and downward may be included.

REFERENCE SIGNS LIST

1 flap gate
2 door
3 door support arm

4 swing support shaft
5 weight arm
6 balancing weight
7, 7A, 7B, 7C, 7D watertight structure for flap gate
8 doorstop
21 inner water-side surface
23 lower edge
72 gap opening-closing member
73 opening operation assist means
74 closing operation assist means
82 side doorstop portion
83 lower doorstop portion
84 gap opening-closing member receiving portion
85 swing portion damage preventing portion
731 lifting weight
732 lift-up operation section
733 seesaw portion
734 lift-up connection portion
736 assist arm
737 open state holding weight
741 close-contact float
745 connection member
100 floodgate
200 opening portion
300 bottom face
C gap between door and bottom face
c gap between gap opening-closing member and bottom face

The invention claimed is:

1. A watertight structure for a flap gate including a door, the door being supported in a weight balance in which the door opens an opening portion of a floodgate in a state in which no external force other than gravity is applied, the watertight structure comprising:

a gap opening-closing member that provides a gap between a lower edge of the door and a bottom face of the floodgate in a state in which the door closes the floodgate, and opens and closes the gap by swinging in a water flow direction;

opening operation assist means for operating the gap opening-closing member into an open state by lifting up the gap opening-closing member to an outer water side; and closing operation assist means for operating the gap opening-closing member held in the open state into a closed state by buoyancy generated when submerged in water.

2. A watertight structure for a flap gate including a door, the door being supported in a weight balance in which the door opens an opening portion of a floodgate in a state in which no external force other than gravity is applied, the watertight structure comprising:

a gap opening-closing member that provides a gap between a lower edge of the door and a bottom face of the floodgate in a state in which the door closes the floodgate, and opens and closes the gap by swinging in a water flow direction; and opening operation assist means for operating the gap opening-closing member into an open state by lifting up the gap opening-closing member to an outer water side, wherein the opening operation assist means includes an assist arm that is fixed to a lower surface of the gap opening-closing member and that extends to an inner water side relative to the gap opening-closing member, and an open state holding weight that is disposed at an inner water-side end portion of the assist arm and that brings the gap opening-closing member into the open state by lifting up the gap opening-closing member to the outer water side via a weight balance.

3. The watertight structure for a flap gate according to claim 2, further comprising;

closing operation assist means for operating the gap opening-closing member held in the open state into a closed state by buoyancy generated when submerged in water, wherein the closing operation assist means includes a press-contact float that is disposed at the inner water-side end portion of the assist arm and that brings the gap opening-closing member into press-contact with a doorstop of the floodgate opening portion by pulling the gap opening-closing member to the inner water side by buoyancy generated when submerged in water.

4. The watertight structure for a flap gate according to claim 2, further comprising;

closing operation assist means for operating the gap opening-closing member held in the open state into a closed state by buoyancy generated when submerged in water, wherein the closing operation assist means includes a connection member including an end connected to the inner water-side end portion of the assist arm, and a press-contact float that is connected to another end of the connection member, that is provided on an inner water-side surface of the door in such a manner as to be capable of moving upward and downward and that along with a rise due to buoyancy generated when submerged in water, lifts up the inner water-side end portion of the assist arm to pull the gap opening-closing member to the inner water side and thereby bring the gap opening-closing member into press contact with a doorstop of the floodgate opening portion.

5. A watertight structure for a flap gate including a door, the door being supported in a weight balance in which the door opens an opening portion of a floodgate in a state in which no external force other than gravity is applied, the watertight structure comprising:

a gap opening-closing member that provides a gap between a lower edge of the door and a bottom face of the floodgate in a state in which the door closes the floodgate, and opens and closes the gap by swinging in a water flow direction; and opening operation assist means for operating the gap opening-closing member into an open state by lifting up the gap opening-closing member to an outer water side, wherein the opening operation assist means includes a lifting weight capable of moving upward and downward, and a lift-up operation section that operates the gap opening-closing member into the open state by lifting up the gap opening-closing member to the outer water side via a direction conversion mechanism that converts tension in a gravity direction generated by self-weight of the lifting weight into a force in a lift-up direction.

6. The watertight structure for a flap gate according to claim 5, wherein the lifting weight has a floating function that makes the lifting weight rise by buoyancy generated when submerged in water along with a rise in water level.

7. The watertight structure for a flap gate according to claim 5, wherein the lift-up operation section includes a seesaw portion that is swingably supported and that includes an end portion at which the lifting weight is provided, and a lift-up connection portion that connects another end portion of the seesaw portion and the gap opening-closing member and that lifts up the gap opening-closing member to the outer water side.

8. The watertight structure for a flap gate according to claim 7, wherein the lift-up connection portion includes a rigid body and further functions as closing operation assist means for operating the gap opening-closing member into a closed state by buoyancy of the lifting weight generated when submerged in water.

* * * * *